US009373313B2

(12) United States Patent
Chapman et al.

(10) Patent No.: US 9,373,313 B2
(45) Date of Patent: Jun. 21, 2016

(54) SYSTEM AND METHOD OF STORING AND ACCESSING MUSICAL PERFORMANCE ON REMOTE SERVER

(71) Applicant: Fender Musical Instruments Corporation, Scottsdale, AZ (US)

(72) Inventors: Keith L. Chapman, Fountain Hills, AZ (US); Charles C. Adams, Gilbert, AZ (US); Kenneth W. Porter, Scottsdale, AZ (US); Stanley J. Cotey, Mesa, AZ (US)

(73) Assignee: Fender Musical Instruments Corporation, Scottsdale, AZ (US)

( * ) Notice: Subject to any disclaimer, the term of this patent is extended or adjusted under 35 U.S.C. 154(b) by 0 days.

(21) Appl. No.: 13/645,365

(22) Filed: Oct. 4, 2012

(65) Prior Publication Data

US 2014/0096667 A1 Apr. 10, 2014

(51) Int. Cl.
*G10H 7/00* (2006.01)
*G10H 1/00* (2006.01)

(52) U.S. Cl.
CPC ..... *G10H 1/0058* (2013.01); *G10H 1/0083* (2013.01); *G10H 2210/155* (2013.01)

(58) Field of Classification Search
CPC ..... G10H 1/0058; G10H 1/0083; G10H 2210/155
USPC ..... 84/610, 645, 735, 742
See application file for complete search history.

(56) References Cited

U.S. PATENT DOCUMENTS

| | | | | |
|---|---|---|---|---|
| 5,270,475 | A | 12/1993 | Weiss et al. | |
| 5,563,359 | A * | 10/1996 | Okamura | 84/600 |
| 5,837,912 | A | 11/1998 | Eagen | |
| 6,067,566 | A | 5/2000 | Moline | |
| 6,353,169 | B1 | 3/2002 | Juszkiewicz et al. | |
| 6,686,530 | B2 | 2/2004 | Juszkiewicz et al. | |
| 6,787,690 | B1 | 9/2004 | Celi et al. | |
| 6,888,057 | B2 | 5/2005 | Juszkiewicz et al. | |
| 6,914,181 | B2 | 7/2005 | Toshitani | |
| 7,081,580 | B2 * | 7/2006 | Brinkman et al. | 84/609 |
| 7,129,408 | B2 * | 10/2006 | Uehara | 84/645 |
| 7,164,076 | B2 | 1/2007 | McHale et al. | |
| 7,166,794 | B2 | 1/2007 | Juszkiewicz et al. | |

(Continued)

FOREIGN PATENT DOCUMENTS

WO 2012058497 A1 5/2012

*Primary Examiner* — Jeffrey Donels
(74) *Attorney, Agent, or Firm* — Robert D. Atkins; Patent Law Group: Atkins and Associates, P.C.

(57) ABSTRACT

A musical system uses a musical instrument with a first communication link and music related accessory with a second communication link for transmitting and receiving the audio signal and control data. A controller within the musical instrument or music related accessory is coupled to the first communication link for receiving control data to control operation of the musical instrument and transmitting an audio signal originating from the musical instrument through the first communication link as a cloud storage recording on a server connected to the first communication link. The cloud storage recording is initiated by detecting motion of the musical instrument or presence of the audio signal. The cloud storage recording is terminated a predetermined period of time after detecting no motion of the musical instrument or absence of the audio signal. A user control interface configures the musical instrument and the music related accessory.

31 Claims, 10 Drawing Sheets

(56) References Cited

U.S. PATENT DOCUMENTS

| | | | | |
|---|---|---|---|---|
| 7,220,912 | B2 | 5/2007 | Juszkiewicz et al. | |
| 7,220,913 | B2 | 5/2007 | Juszkiewicz et al. | |
| 7,241,948 | B2 | 7/2007 | Cummings | |
| 7,358,433 | B2 | 4/2008 | Kondo et al. | |
| 7,399,913 | B1 | 7/2008 | Juszkiewicz et al. | |
| 7,420,112 | B2 | 9/2008 | Juszkiewicz et al. | |
| 7,563,977 | B2 | 7/2009 | Cummings | |
| 7,741,556 | B2 | 6/2010 | Demsey et al. | |
| 7,799,986 | B2 * | 9/2010 | Ryle et al. | 84/737 |
| 7,952,014 | B2 | 5/2011 | Juszkiewicz et al. | |
| 8,314,319 | B2 * | 11/2012 | Yokoyama et al. | 84/602 |
| 8,509,692 | B2 * | 8/2013 | Ryle et al. | 455/41.3 |
| 8,796,528 | B2 * | 8/2014 | Uehara et al. | 84/645 |
| 8,962,967 | B2 * | 2/2015 | Yoshikawa | 84/744 |
| 2006/0123976 | A1 * | 6/2006 | Both et al. | 84/600 |
| 2006/0283310 | A1 | 12/2006 | Bicker | |
| 2008/0260184 | A1 | 10/2008 | Bailey et al. | |
| 2008/0307949 | A1 | 12/2008 | Lee | |
| 2009/0129605 | A1 * | 5/2009 | Camp et al. | 381/77 |
| 2009/0183622 | A1 | 7/2009 | Parash | |
| 2010/0031804 | A1 | 2/2010 | Chevreau et al. | |
| 2010/0319518 | A1 * | 12/2010 | Mehta | 84/625 |
| 2011/0146476 | A1 * | 6/2011 | Zimmerman | 84/470 R |
| 2011/0246619 | A1 * | 10/2011 | Gregson | 709/219 |
| 2012/0189018 | A1 | 7/2012 | Diab et al. | |
| 2012/0304847 | A1 * | 12/2012 | Hacker | 84/470 R |
| 2013/0027404 | A1 * | 1/2013 | Sarnoff | 345/441 |

* cited by examiner

SYSTEM AND METHOD OF STORING AND ACCESSING MUSICAL PERFORMANCE ON REMOTE SERVER

FIELD OF THE INVENTION

The present invention relates to musical instruments and, more particularly, to a system and method of storing and accessing a musical performance on a remote storage server over a network.

BACKGROUND OF THE INVENTION

Musical instruments have always been very popular in society providing entertainment, social interaction, self-expression, and a business and source of livelihood for many people. Musical instruments and related accessories are used by professional and amateur musicians to generate, alter, transmit, and reproduce audio signals. Common musical instruments include an electric guitar, bass guitar, violin, horn, brass, drums, wind instrument, string instrument, piano, organ, electric keyboard, and percussions. The audio signal from the musical instrument is typically an analog signal containing a progression of values within a continuous range. The audio signal can also be digital in nature as a series of binary one or zero values. The musical instrument is often used in conjunction with related musical accessories, such as microphones, audio amplifiers, speakers, mixers, synthesizers, samplers, effects pedals, public address systems, digital recorders, and similar devices to capture, alter, combine, store, play back, and reproduce sound from digital or analog audio signals originating from the musical instrument.

Musicians often make impromptu use of musical instruments. Accordingly, a musician will often pick up and play an instrument without advanced planning or intent. The impromptu session can happen anytime the musician has an instrument, such as after a performance at a club, relaxing at home in the evening, at work during a lunch break, or while drinking coffee at a cafe. An impromptu session can include multiple musicians and multiple instruments. The impromptu session often results in the creation of novel compositions that have purpose or value, or are otherwise useful to the musician. The compositions will be lost if the musician was not prepared or not able to record the composition at the time of the impromptu session, either for lack of a medium to record the composition on or lack of time to make the recording. Also, the actions required to record the composition can interfere with the creative process. In any case, the circumstances may not afford the opportunity to record a performance at a planned or unplanned session, even when recording capability is available.

SUMMARY OF THE INVENTION

A need exists to record a musical composition originating from use of a musical instrument. Accordingly, in one embodiment, the present invention is a communication network for recording a musical performance comprising a musical instrument including a first communication link disposed on the musical instrument. An audio amplifier includes a second communication link disposed on the audio amplifier. An access point routes an audio signal and control data between the musical instrument and audio amplifier through the first communication link and second communication link. A musical performance originating from the musical instrument is detected and transmitted through the access point as a cloud storage recording.

In another embodiment, the present invention is a musical system comprising a musical instrument and first communication link disposed on the musical instrument. A controller is coupled to the first communication link for receiving control data to control operation of the musical instrument and transmitting an audio signal originating from the musical instrument through the first communication link as a cloud storage recording.

In another embodiment, the present invention is a musical system comprising a musical related instrument including a communication link disposed on the musical related instrument. A controller is coupled for receiving control data from the communication link to control operation of the musical related instrument and transmitting an audio signal from the musical related instrument through the communication link as a cloud storage recording.

In another embodiment, the present invention is a method of recording a musical performance comprising the steps of providing a musical related instrument including a communication link disposed on the musical related instrument, and transmitting data from the musical related instrument through the communication link as a cloud storage recording.

DETAILED DESCRIPTION OF THE DRAWINGS

The present invention is described in one or more embodiments in the following description with reference to the figures, in which like numerals represent the same or similar elements. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings.

Electronic data is commonly stored on a computer system. The data can be stored on a local hard drive, or on a server within a local area network, or remotely on one or more external servers outside the local area network. The remote storage is sometimes referred to as cloud storage as the user may not know where the data physically resides, but knows how to access the data by virtual address through a network connection, e.g. the Internet. The cloud storage is managed by a company or public service agency and can physically exist in any state or country. Thus, the user in one location with access to a wired or wireless network connection can create, modify, retrieve, and manage data stored on a server at a different location without incurring the cost associated with acquiring and maintaining large local data storage resources. The cloud storage service maintains the availability, integrity, security, and backup of the data, typically for a nominal fee to the user.

Cloud storage is implemented using a plurality of servers connected over a public or private network, each server containing a plurality of mass storage devices. The user of cloud storage accesses data through a virtual location, such as a universal resource locator (URL), which the cloud storage system translates into one or more physical locations within storage devices. The user of cloud storage typically share all or part of the underlying implementation of the cloud storage with other users. Because the underlying implementation of the storage is shared by many users, the cost per unit of storage, i.e., the cost per gigabyte, can be substantially lower than for dedicated local mass storage. Redundant data storage, automatic backup, versioning, and journaled filesystems can be provided to users who would otherwise find such features prohibitively expensive or complicated to administer. A user of cloud storage can keep the data private or share selected data with one or more other users.

Figure 1:
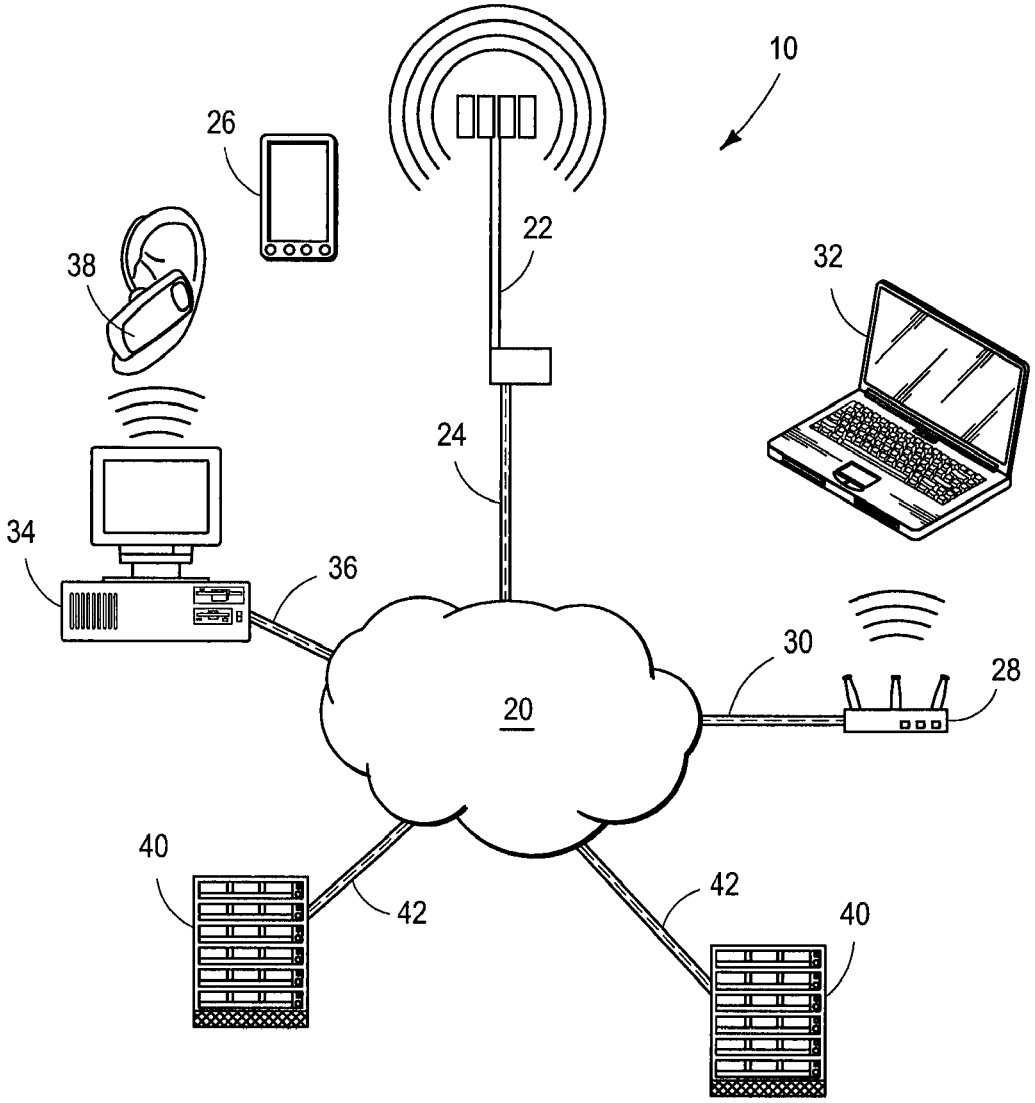
FIG. 1 illustrates electronic devices connected to a network through a communication system.

FIG. 1 shows devices and features of electronic system 10. Within electronic system 10, communication network 20 includes local area networks (LANs), wireless local area networks (WLANs), wide area networks (WANs), and the Internet for routing and transportation of data between various points in the network. The devices within communication network 20 are connected together through a communication infrastructure including a coaxial cable, twisted pair cable, Ethernet cable, fiber optic cable, RF link, microwave link, satellite link, telephone line, or other wired or wireless communication link. Communication network 20 is a distributed network of interconnected routers, gateways, switches, bridges, modems, domain name system (DNS) servers, dynamic host configuration protocol (DHCP) servers, each with a unique internet protocol (IP) address to enable communication between individual computers, cellular telephones, electronic devices, or nodes within the network. In one embodiment, communication network 20 is a global, open-architecture network, commonly known as the Internet. Communication network 20 provides services such as address resolution, routing, data transport, secure communications, virtual private networks (VPN), load balancing, and failover support.

Electronic system 10 further includes cellular base station 22 connected to communication network 20 through bi-directional communication link 24 in a hard-wired or wireless configuration. Communication link 24 includes a coaxial cable, Ethernet cable, twisted pair cable, telephone line, waveguide, microwave link, fiber optic cable, power line communication link, line-of-sight optical link, satellite link, or other wired or wireless communication link. Cellular base station 22 uses radio waves to communicate voice and data with cellular devices and provides wireless access to communication network 20 for authorized devices. The radio frequencies used by cellular base station 22 can include the 850 MHz, 900 MHz, 1700 MHz, 1800 MHz, 1900 MHz, 2000 MHz, and 2100 MHz bands. Cellular base station 22 employs one or more of the universal mobile telecommunication system (UMTS), high-speed downlink packet access (HSDPA), high-speed uplink packet access (HSUPA), evolved high-speed packet access (HSPA+), code division multiple access (CDMA), wideband CDMA (WCDMA), global system for mobile communications (GSM), GSM/EDGE, integrated digital enhanced network (iDEN), time division synchronous code division multiple access (TD-SCDMA), LTE, orthogonal frequency division multiplexing (OFDM), flash-OFDM, IEEE 802.16e (WiMAX), or other wireless communication protocols over 3G and 4G networks. Cellular base station 22 can include a cell tower. Alternatively, cellular base station can be a microcell, picocell, or femtocell, i.e., a smaller low-powered cellular base station designed to provide cellular service in limited areas such as a single building or residence.

Cellular device 26 includes cellular phones, smartphones, tablet computers, laptop computers, Wi-Fi hotspots, and other similar devices. The radio frequencies used by cellular device 26 can include the 850 MHz, 900 MHz, 1700 MHz, 1800 MHz, 1900 MHz, 2000 MHz, and 2100 MHz bands. Cellular device 26 employs one or more of the UMTS, HSDPA, HSUPA, HSPA+, CDMA, WCDMA, GSM, GSM/EDGE, iDEN, TD-SCDMA, LTE, WiMAX, OFDM, flash-OFDM, or other wireless communication protocols over 3G and 4G networks. Cellular device 26 communicates with cellular base station 22 over one or more of the frequency bands and wireless communication protocols supported by both the cellular device and the cellular base station. Cellular device 26 uses the connectivity provided by cellular base station 22 to perform tasks such as audio and/or video communications, electronic mail download and upload, short message service (SMS) messaging, browsing the world wide web, downloading software applications (apps), and downloading firmware and software updates, among other tasks. Cellular device 26 includes unique identifier information, typically an international mobile subscriber identity (IMSI) in a replaceable subscriber identity module (SIM) card, which determines which cellular base stations and services the cellular device can use.

Wireless access point (WAP) 28 is connected to communication network 20 through bi-directional communication link 30 in a hard-wired or wireless configuration. Communication link 30 includes a coaxial cable, Ethernet cable, twisted pair cable, telephone line, waveguide, microwave link, fiber optic cable, power line communication link, line-of-sight optical link, satellite link, or other wired or wireless communication link. Alternatively, communication link 30 can be a cellular radio link to cellular base station 22. WAP 28 uses radio waves to communicate data with wireless devices and provides wireless access to communication network 20 for authorized devices. Radio frequencies used by WAP 28 include the 2.4 GHz and 5.8 GHz bands. WAP 28 employs one or more of the IEEE 802.11a, IEEE 802.11b, IEEE 802.11g, IEEE 802.11n (collectively, Wi-Fi) protocols or other wireless communication protocols. WAP 28 can also employ security protocols such as IEEE 802.11i, including Wi-Fi protected access (WPA) and Wi-Fi protected access II (WPA2), to enhance security and privacy. WAP 28 and devices that connect to the WAP using the wireless communication protocols form an infrastructure-mode WLAN. WAP 28 includes a unique media access control (MAC) address that distinguishes WAP 28 from other devices. In one embodiment, WAP 28 is a laptop or desktop computer using a wireless network interface controller (WNIC) and software-enabled access point (SoftAP) software.

WAP 28 also includes a router, firewall, DHCP host, print server, and storage server. A router uses hardware and software to direct the transmission of communications between networks or parts of the network. A firewall includes hardware and software that determines whether selected types of network communication are allowed or blocked and whether communication with selected locations on a local or remote network are allowed or blocked. A DHCP host includes hardware and/or software that assigns IP addresses or similar locally-unique identifiers to devices connected to a network. A print server includes hardware and software that makes printing services available for use by devices on the network. A storage server includes hardware and software that makes persistent data storage such as a hard disk drive (HDD), solid state disk drive (SSD), optical drive, magneto-optical drive, tape drive, or USB flash drive available for use by devices on the network.

Wi-Fi device 32 includes laptop computers, desktop computers, tablet computers, server computers, smartphones, cameras, game consoles, televisions, and audio systems in mobile and fixed environments. Wi-Fi device 32 uses frequencies including the 2.4 GHz and 5.8 GHz bands, and employs one or more of the Wi-Fi or other wireless communication protocols. Wi-Fi device 32 employs security protocols such as WPA and or WPA2 to enhance security and privacy. Wi-Fi device 32 uses the connectivity provided by WAP 28 to perform audio and video applications, download and upload data, browse the web, download apps, play music, and download firmware and software updates. Wi-Fi device 32 includes a unique MAC address that distinguishes Wi-Fi device 32 from other devices connected to WAP 28.

Personal area network (PAN) master device 34 includes desktop computers, laptop computers, audio systems, and smartphones. PAN master device 34 is connected to communication network 20 through bi-directional communication link 36 in a hard-wired or wireless configuration. Communication link 36 includes a coaxial cable, Ethernet cable, twisted pair cable, telephone line, waveguide, microwave link, fiber optic cable, power line communication link, line-of-sight optical link, satellite link, or other wired or wireless communication link. Alternatively, communication link 36 can be a cellular radio link to cellular base station 22 or a Wi-Fi link to WAP 28. PAN master device 34 uses radio waves to communicate with wireless devices. The radio frequencies used by PAN master device 34 can include the 868 MHZ, 915 MHz, 2.4 GHz, and 5.8 GHz bands or ultra wide band (UWB) frequencies, e.g. 9 GHz. PAN master device 34 employs one or more of the Bluetooth, zigbee, IEEE 802.15.3, ECMA-368, or similar PAN protocols, including the pairing, link management, service discovery, and security protocols.

PAN slave device 38 includes headsets, headphones, computer mice, computer keyboards, printers, remote controls, game controllers, and other such devices. PAN slave device 38 uses radio frequencies including the 868 MHZ, 915 MHz, 2.4 GHz, and 5.8 GHz bands or UWB frequencies and employs one or more of the bluetooth, zigbee, IEEE 802.15.3, ECMA-368, or similar PAN protocols, including the pairing, link management, service discovery, and security protocols. PAN slave device 38 uses the connectivity provided by PAN master device 34 to exchange commands and data with the PAN master device.

Computer servers 40 connect to communication network 20 through bi-directional communication links 42 in a hard-wired or wireless configuration. Computer servers 40 include a plurality of mass storage devices or arrays, such as HDD, SSD, optical drives, magneto-optical drives, tape drives, or USB flash drives. Communication link 42 includes a coaxial cable, Ethernet cable, twisted pair cable, telephone line, waveguide, microwave link, fiber optic cable, power line communication link, line-of-sight optical link, satellite link, or other wired or wireless communication link. Servers 40 provide file access, database, web access, mail, backup, print, proxy, and application services. File servers provide data read, write, and management capabilities to devices connected to communication network 20 using protocols such as the hypertext transmission protocol (HTTP), file transfer protocol (FTP), secure FTP (SFTP), network file system (NFS), common internet file system (CIFS), apple filing protocol (AFP), andrew file system (AFS), iSCSI, and fibre channel over IP (FCIP). Database servers provide the ability to query and modify one or more databases hosted by the server to devices connected to communication network 20 using a language, such as structured query language (SQL). Web servers allow devices on communication network 20 to interact using HTTP with web content hosted by the server and implemented in languages such as hypertext markup language (HTML), javascript, cascading style sheets (CSS), and PHP: hypertext preprocessor (PHP). Mail servers provide electronic mail send, receive, and routing services to devices connected to communication network 20 using protocols such as simple network mail protocol (SNMP), post office protocol 3 (POP3), internet message access protocol (IMAP), and messaging application programming interface (MAPI). Catalog servers provide devices connected to communication network 20 with the ability to search for information in other servers on communication network 20. Backup servers provide data backup and restore capabilities to devices connected to communication network 20. Print servers provide remote printing capabilities to devices connected to communication network 20. Proxy servers serve as intermediaries between other servers and devices connected to communication network 20 in order to provide security, anonymity, usage restrictions, bypassing of censorship, or other functions. Application servers provide devices connected to communication network 20 with the ability to execute on the server one or more applications provided on the server.

Figure 2:
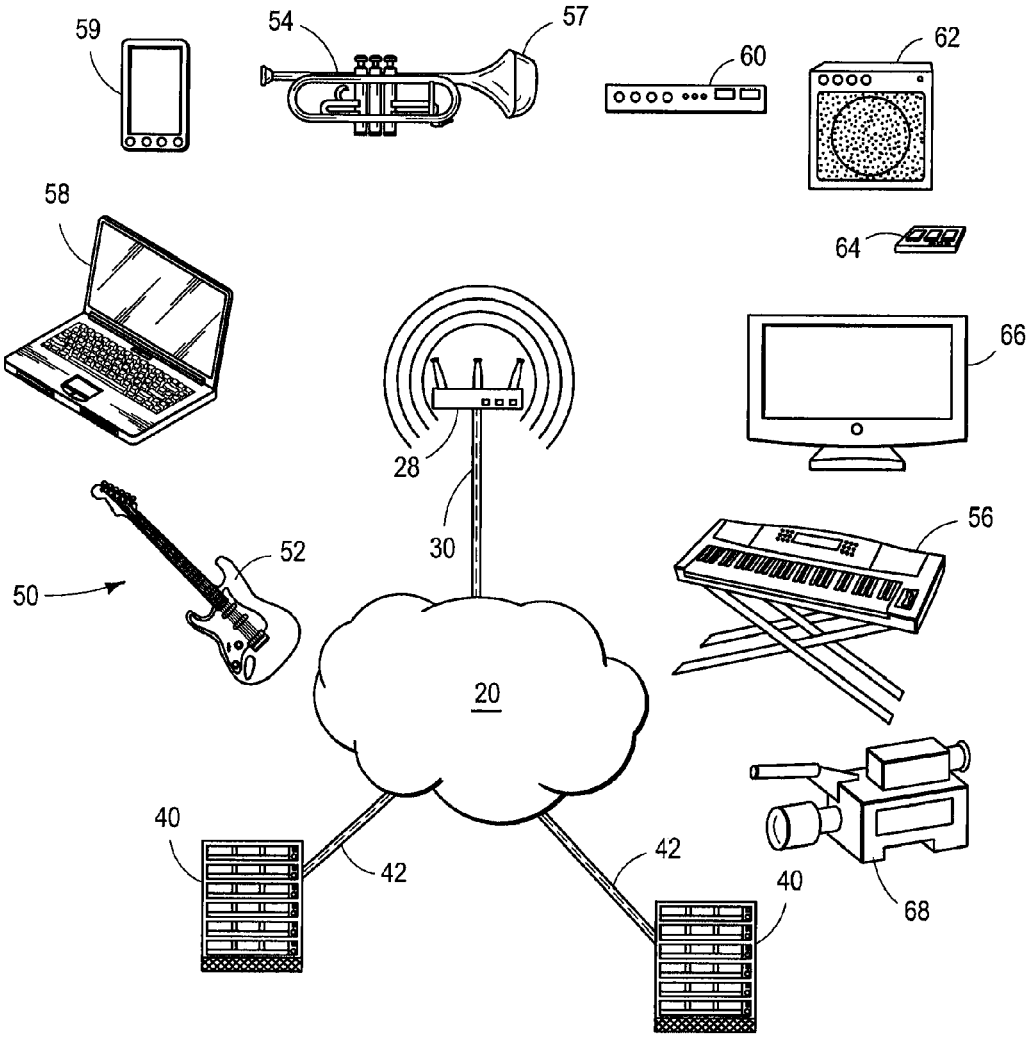
FIG. 2 illustrates musical instruments and musical related accessories connected to a wireless access point.

FIG. 2 shows an embodiment of electronic system 10 as wireless communication network 50 for connecting, configuring, monitoring, and controlling musical instruments and musical related accessories within a musical system. In particular, wireless communication network 50 uses WAP 28 to send and receive analog or digital audio signals, video signals, control signals, and other data between musical instruments and musical related accessories, as well as other devices within electronic system 10, such as communication network 20 and servers 40. WAP 28 is connected to communication network 20 by communication link 30. Communication network 20 is connected to servers 40 by communication links 42. WAP 28 can also be connected to other devices within electronic system 10, including cellular device 26, Wi-Fi device 32, PAN master device 34, and PAN slave device 38.

In the present embodiment, WAP 28 communicates with musical instruments (MI) 52, 54, and 56 depicted as an electric guitar, trumpet, and electric keyboard, respectively. Other musical instruments that can be connected to WAP 28 include a bass guitar, violin, brass, drums, wind instrument, string instrument, piano, organ, percussions, keyboard, synthesizer, and microphone. For MI that emit sound waves directly, a microphone or other sound transducer attached to or disposed in the vicinity of the MI converts the sound waves to electrical signals, such as cone 57 mounted to trumpet 54. WAP 28 further communicates with laptop computer 58, mobile communication device 59, audio amplifier 60, speaker 62, effects pedal 64, display monitor 66, and camera 68. MI 52-56 and accessories 58-68 each include an internal or external wireless transceiver and controller to send and receive analog or digital audio signals, video signals, control signals, and other data through WAP 28 between and among the devices, as well as communication network 20, cellular device 26, Wi-Fi device 32, PAN master device 34, PAN slave device 38, and servers 40. In particular, MI 52-56 and accessories 58-68 are capable of transmitting and receiving audio signals, video signals, control signals, and other data through WAP 28 and communication network 20 to cloud storage implemented on servers 40.

Consider an example where one or more users play a musical composition on MI 52-56. The user may be on stage, in a recording studio, in a home, in a coffee shop, in the park, in a motor vehicle, or any other location with wired or wireless access to electronic system 10 and communication network 20. The user wants to manually or automatically configure MI 52-56 and musical related accessories 60-68 and then record the play of the musical composition. The configuration data of MI 52-56 corresponding to the musical composition is stored on laptop computer 58, mobile communication device 59, or internal memory of the MI. The configuration data for the musical composition is transmitted from laptop computer 58 or mobile communication device 59 through WAP 28 to MI 52-56. For MI 52, the configuration data selects one or more pickups on the guitar as the source of the audio signal, as well as the volume and tonal qualities of the audio signal transmitted to an output jack. For MI 54, the configuration data selects sensitivity, frequency conversion settings, volume, and tone of cone 57. For MI 56, the configuration data sets the volume, balance, sequencing, tempo, mixer, tone, effects, MIDI interface, and synthesizer. The configuration data of audio amplifier 60, speaker 62, effects pedal 64, and camera 68 is also stored on laptop computer 58, mobile communication device 59, or internal memory of the accessory. The configuration data for the musical composition is transmitted from laptop computer 58 or mobile communication device 59 through WAP 28 to audio amplifier 60, speaker 62, effects pedal 64, and camera 68, as well as other electronic accessories within wireless communication network 50. For audio amplifier 60, the configuration data sets the amplification, volume, gain, filtering, tone equalization, sound effects, bass, treble, midrange, reverb dwell, reverb mix, vibrato speed, and vibrato intensity. For speaker 62, the configuration data sets the volume and special effects. For effects pedal 64, the configuration data sets the one or more sound effects.

Once MI 52-56 and accessories 60-68 are configured, the user begins to play the musical composition. The audio signals generated from MI 52-56 are transmitted through WAP 28 to audio amplifier 60, which performs the signal processing of the audio signal according to the configuration data. The audio signal can also be speech or voice data from a microphone. The configuration of MI 52-56 and audio amplifier 60 can be updated at any time during the play of the musical composition. The configuration data is transmitted to devices 52-68 to change the signal processing of the audio signal in realtime. The user can modify the signal processing function during play by pressing on effects pedal 64 to introduce a sound effect. The user operation on effects pedal 64 is transmitted through WAP 28 to audio amplifier 60, which implements on the user operated sound effects. Other electronic accessories, e.g. a synthesizer, can also be introduced into the signal processing audio amplifier 60 through WAP 28. The output signal of audio amplifier 60 is transmitted through WAP 28 to speaker 62. In some cases, speaker 62 handles the power necessary to reproduce the sound. In other cases, audio amplifier 60 can be connected to speaker 62 by audio cable to deliver the necessary power to reproduce the sound.

In addition, the analog or digital audio signals, video signals, control signals, and other data from MI 52-56 and musical related accessories 60-68 are transmitted through WAP 28 and stored on laptop computer 58, cell phone or mobile communication device 59, PAN master device 34, or servers 40 as a recording of the play of the musical composition. The recording can be made at any time and any place with wired or wireless access to electronic system 10 or communication network 50, without prior preparation, e.g. for an impromptu playing session. The destination of the audio signals is selected with PAN master device 34, laptop computer 58, or mobile communication device 59. For example, the user selects the destination of the recording as cloud servers 40. As the user plays the musical composition, the audio signals, video signals, control signals, and other data from MI 52-56 and accessories 60-68 are transmitted through WAP 28 in realtime and stored on servers 40. The audio signals, video signals, control signals, and other data can be formatted as musical instrument digital interface (MIDI) data and stored on servers 40. The recording stored on cloud servers 40 is available for later access by the user or other person authorized to access the recording.

The user may enable the recording of the musical composition by a physical act, such as pressing a start recording button on MI 52-56 or accessories 58-68, playing a predetermined note or series of notes on MI 52-56, voice activation with a verbal instruction "start recording" through a microphone, or dedicated remote controller. The recording of the musical composition can be enabled upon detection of motion, handling, or other user-initiated activity associated with MI 52-56, or detection of audio signals being generated by MI 52-56. The user-initiated activity can be handling an electric guitar, strumming the strings of a bass, pressing keys on the keyboard, moving the slide of a trumpet, and striking a drum. The presence of user-initiated activity or detection of the audio signal indicates that music is being played and initiates the recording. Alternatively, the recording of the musical composition can be enabled during a certain time of day (8 am to 8 pm) or by location detection, e.g. start recording when the user enters the recording studio as detected by a global position system (GPS) within MI 52-56. The recording can be enabled continuously (24×7), whether or not audio signals are being generated. The user can retrieve the recording from servers 40 and listen to the musical composition through speakers 62, PAN slave device 38, laptop computer 58, or mobile communication device 59. The recording as stored on servers 40 memorializes the musical composition for future access and use.

MI 52-56 or accessories 58-68 can include a mark button or indicator located on the MI or accessory. The user presses the mark button to flag a specific portion or segment of the recorded data at any point in time of playing the musical composition for later review. The mark flags are searchable on servers 40 for ready access.

The audio signal is stored on servers 40 as a cloud storage recording. The cloud storage recording can also include video data and control data. The file name for the cloud storage recording can be automatically assigned or set by the user. Servers 40 provide a convenient medium to search, edit, share, produce, or publish the cloud recording. The user can search for a particular cloud storage recording by user name, time and date, instrument, accessory settings, tempo, mark flags, and other metadata. For example, the user can search for a guitar recording made in the last week with Latin tempo.

The user can edit the cloud storage recording, e.g. by mixing in additional sound effects. The user can make the cloud storage recording available to fellow musicians, friends, fans, and business associates as needed. The cloud storage recording can track performance metrics, such as number of hours logged. The GPS capability allows the user to determine the physical location of MI 52-56 if necessary and provide new owner registration.

Figure 3:
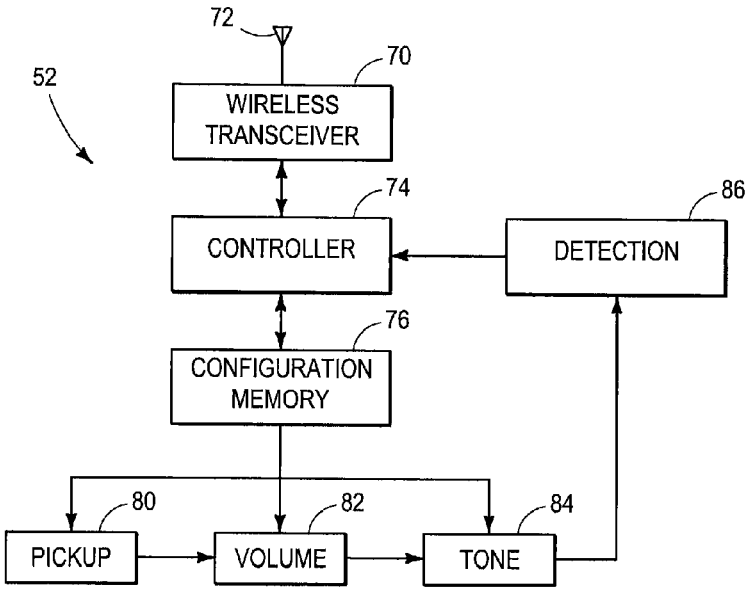
FIG. 3 illustrates a wireless interface to a guitar.

FIG. 3 illustrates further detail of MI 52 including internal or external wireless transceiver 70 for sending and receiving analog or digital audio signals, video signals, control signals, and other data from WAP 28 through antenna 72. Wireless transceiver 70 includes oscillators, modulators, demodulators, phased-locked loops, amplifiers, correlators, filters, baluns, digital signal processors, general-purpose processors, media access controllers (MAC), physical layer (PHY) devices, firmware, and software to implement a wireless data transmit and receive function. Antenna 72 converts RF signals from wireless transceiver 70 into radio waves that propagate outward from the antenna and converts radio waves incident to the antenna into RF signals that are sent to the wireless transceiver. Wireless transceiver 70 can be disposed on the body of MI 52 or internal to the MI. Antenna 72 includes one or more rigid or flexible external conductors, traces on a PC board, or conductive elements formed in or on a surface of MI 52.

Controller 74 controls routing of audio signals, video signals, control signals, and other data through MI 52. Controller 74 includes one or more processors, volatile memories, non-volatile memories, control logic and processing, interconnect busses, firmware, and software to implement the requisite control function. Volatile memory includes latches, registers, cache memories, static random access memory (SRAM), and dynamic random access memory (DRAM). Non-volatile memory includes read-only memory (ROM), programmable read-only memory (PROM), erasable programmable read-only memory (EPROM), electrically erasable programmable read-only memory (EEPROM), serial EPROM, magneto-resistive random-access memory (MRAM), ferro-electric RAM (F-RAM), phase-change RAM (PRAM), and flash memory. Control logic and processing includes programmable digital input and output ports, universal synchronous/asynchronous receiver/transmitter (USARTs), digital to analog converters (DAC), analog to digital converters (ADC), display controllers, keyboard controllers, universal serial bus (USB) controllers, I2C controllers, network interface controllers (NICs), and other network communication circuits. Controller 74 can also include signal processors, accelerators, or other specialized circuits for functions such as signal compression, filtering, noise reduction, and encryption. In one embodiment, controller 74 is implemented as a web server.

The control signals and other data received from WAP 28 are stored in configuration memory 76. The audio signals are generated by the user playing MI 52 and output from pickup 80. MI 52 may have multiple pickups 80, each with a different response to the string motion. The configuration data selects and enables one or more pickups 80 to convert string motion to the audio signals. Signal processing 82 and volume 84 modify digital and analog audio signals. The control signals and other data stored in configuration memory 76 set the operational state of pickup 80, signal processing 82, and volume 84. The audio output signal of volume 84 is routed to controller 74, which transmits the audio signals through wireless transceiver 70 and antenna 72 to WAP 28. The audio signals continue to the designated destination, e.g. audio amplifier 60, laptop computer 58, mobile communication device 59, PAN master device 34, or servers 40.

Detection block 86 detects when MI 52 is in use by motion, presence of audio signals, or other user initiated activity. In one embodiment, detection block 86 monitors for non-zero audio signals from pickup 80 or volume 84. The audio signal can be detected with signal amplifier, compensator, frequency filter, noise filter, or impedance matching circuit. Alternatively, detection block 86 includes an accelerometer, inclinometer, touch sensor, strain gauge, switch, motion detector, optical sensor, or microphone to detect user initiated activity associated with MI 52. For example, an accelerometer can sense movement of MI 52; a capacitive, resistive, electromagnetic, or acoustic touch sensor can sense a user contact with a portion of the MI; a strain gauge, switch, or opto-interrupter can detect the movement of the strings on MI 52 or when the MI is being supported by a strap or stand; a microphone can detect acoustic vibrations in the air or in a surface of MI 52. In one embodiment, a motion detector or opto-interrupter is placed under the strings of MI 52 to detect the string motion indicating playing action. Upon detection of playing of the musical composition, detection block 86 sends a start recording signal through controller 74, wireless transceiver 70, antenna 72, WAP 28, and communication network 20 to servers 40 using the WPS, Wi-Fi Direct, or another wired or wireless setup protocol. Servers 40 begin storing the audio signals, video signals, control signals, and other data on mass storage arrays. The audio signal is transmitted over a secure connection through controller 74, wireless transceiver 70, antenna 72, WAP 28, and communication network 20 and recorded on cloud servers 40 with associated timestamps, tags, and identifiers. The audio signals, video signals, control signals, and other data can be formatted as MIDI data and stored on servers 40.

Servers 40 continue recording until a stop recording signal is received, recording time-out, or the recording is otherwise disabled. The recording can be disabled by a physical act, such as pressing a stop recording button on MI 52 or accessories 58-68, playing a predetermined note or series of notes on MI 52, voice activation with a verbal instruction "stop recording" through a microphone, or dedicated remote controller. The recording of the musical composition can be disabled after a predetermined period of time or upon detection of the absence of motion of MI 52 or detection of no audio signals being generated by MI 52 for a predetermined period of time. For example, if MI 52 is idle for say 15 minutes, either in terms of physical motion or no audio signal, then the recording is discontinued. The absence of motion of MI 52 or no audio signal indicates that music is no longer being played and the recording is suspended. Alternatively, the recording of the musical composition can be disabled during a certain time of day (8 pm to 8 am) or by location detection, e.g. stop recording when the user leaves the recording studio as detected by GPS within MI 52.

Figure 4:
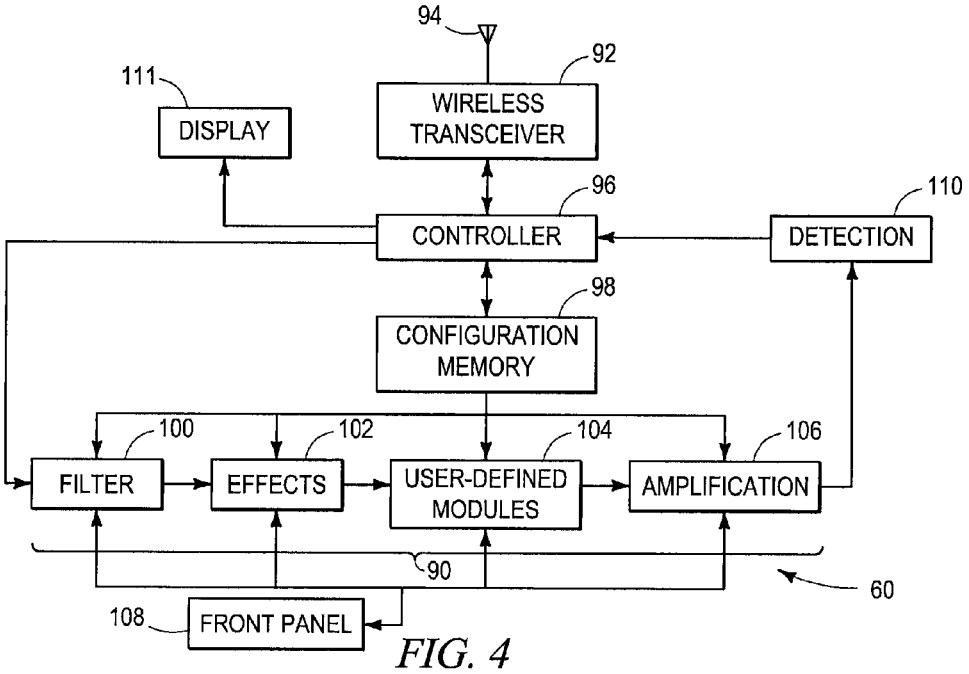
FIG. 4 illustrates a wireless interface to an audio amplifier.

FIG. 4 illustrates further detail of audio amplifier 60 including signal processing section 90 and internal or external wireless transceiver 92. Wireless transceiver 92 sends and receives analog or digital audio signals, video signals, control signals, and other data from WAP 28 through antenna 94. The audio signals, video signals, control signals, and other data may come from MI 52-56 and accessories 58-68. Controller 96 controls routing of audio signals, video signals, control signals, and other data through audio amplifier 60, similar to controller 74. In one embodiment, controller 96 is implemented as a web server. The control signals and other data are stored in configuration memory 98. The audio signals are routed through filter 100, effects 102, user-defined modules 104, and amplification block 106 of signal processing section 90. Filter 100 provides various filtering functions, such as low-pass filtering, bandpass filtering, and tone equalization functions over various frequency ranges to boost or attenuate the levels of specific frequencies without affecting neighboring frequencies, such as bass frequency adjustment and treble frequency adjustment. For example, the tone equalization may employ shelving equalization to boost or attenuate all frequencies above or below a target or fundamental frequency, bell equalization to boost or attenuate a narrow range of frequencies around a target or fundamental frequency, graphic equalization, or parametric equalization. Effects 102 introduce sound effects into the audio signal, such as reverb, delays, chorus, wah, auto-volume, phase shifter, hum canceller, noise gate, vibrato, pitch-shifting, tremolo, and dynamic compression. User-defined modules 104 allows the user to define customized signal processing functions, such as adding accompanying instruments, vocals, and synthesizer options. Amplification block 106 provides power amplification or attenuation of the audio signal.

The control signals and other data stored in configuration memory 98 set the operational state of filter 100, effects 102, user-defined modules 104, and amplification block 106. In one embodiment, the configuration data sets the operational state of various electronic amplifiers, DAC, ADC, multiplexers, memory, and registers to control the signal processing within audio amplifier 60. Controller 96 may set the operational value or state of a control servomotor-controlled potentiometer, servomotor-controlled variable capacitor, amplifier with electronically controlled gain, or an electronically-controlled variable resistor, capacitor, or inductor. Controller 96 may set the operational value or state of a stepper motor or ultrasonic motor mechanically coupled to and capable of rotating a volume, tone, or effect control knob, electronically-programmable power supply adapted to provide a bias voltage to tubes, or mechanical or solid-state relay controlling the flow of power to audio amplifier 60. Alternatively, the operational state of filter 100, effects 102, user-defined modules 104, and amplification block 106 can be set manually through front panel 108.

Detection block 110 detects when audio amplifier 60 is operational by the presence of audio signals. In one embodiment, detection block 110 monitors for non-zero audio signals from MI 52. The audio signal can be detected with a signal amplifier, compensator, frequency filter, noise filter, or impedance matching circuit. Upon detection of the audio signal, detection block 110 sends a start recording signal through controller 96, wireless transceiver 92, antenna 94, WAP 28, and communication network 20 to servers 40. Servers 40 begin storing the audio signals, video signals, control signals, and other data on mass storage arrays. Each note or chord played on MI 52-56 is processed through audio amplifier 60, as configured by controller 96 and stored in configuration memory 98, to generate an audio output signal of signal processing section 90. The post signal processing audio output signal of signal processing section 90 is routed to controller 96 and transmitted through wireless transceiver 92 and antenna 94 to WAP 28 using the WPS, Wi-Fi Direct, or another wired or wireless setup protocol. The post signal processing audio signals continue to the next musical related accessory, e.g. speaker 62 or other accessory 58-68. The post signal processing audio signals is also transmitted over a secure connection through communication network 20 and recorded on cloud servers 40 with associated timestamps, tags, and identifiers. The audio signals, video signals, control signals, and other data can be formatted as MIDI data and stored on servers 40.

Display 111 shows the present state of controller 96 and configuration memory 98 with the operational state of signal processing section 90, as well as the recording status. Controller 96 can also read the present state of configuration memory 98 with the operational state of signal processing section 90 and recording status for transmission through wireless transceiver 92, antenna 94, and WAP 28 for storage or display on PAN master device 34, laptop computer 58, and mobile communication device 59.

Servers 40 continue recording until a stop recording signal is received, recording time-out, or the recording is otherwise disabled. The recording of the musical composition can be disabled after a predetermined period of time or upon detection of no audio signals being generated by audio amplifier 60 for a predetermined period of time. For example, if audio amplifier 60 is idle for say 15 minutes, then the recording is discontinued. The absence of the audio signal indicates that music is no longer being played and the recording is suspended.

Figure 5:
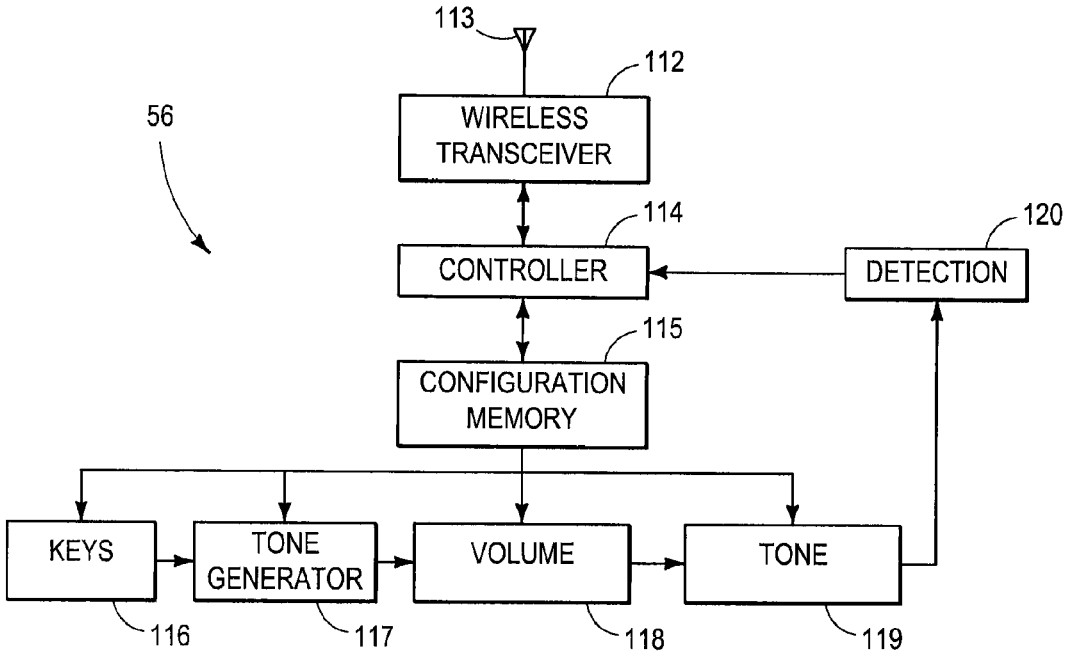
FIG. 5 illustrates a wireless interface to an electric keyboard.

FIG. 5 illustrates further detail of MI 56 including internal or external wireless transceiver 112 for sending and receiving analog or digital audio signals, video signals, control signals, and other data from WAP 28 through antenna 113. Controller 114 controls routing of audio signals, video signals, control signals, and other data through MI 56. The control signals and other data received from WAP 28 are stored in configuration memory 115. The audio signals are generated by the user pressing keys 116. Note generator 117 includes a microprocessor and other signal processing circuits that generate a corresponding audio signal in response to each key 116. The control signals and other data stored in configuration memory 115 set the operational state of note generator 117, volume 118, and tone 119. The audio output signal of tone 119 is routed to controller 114, which transmits the audio signals through wireless transceiver 112 and antenna 113 to WAP 28. The audio signals continue to the designated destination, e.g. audio amplifier 60, laptop computer 58, mobile communication device 59, PAN master device 34, or servers 40.

Detection block 120 detects when MI 56 is in use by motion of keys 116, presence of audio signals, or other user initiated activity. In one embodiment, detection block 120 monitors for non-zero audio signals from tone generator 117 or tone 119. The audio signal can be detected with signal amplifier, compensator, frequency filter, noise filter, or impedance matching circuit. Alternatively, detection block 120 includes an accelerometer, inclinometer, touch sensor, strain gauge, switch, motion detector, optical sensor, or microphone to detect user initiated activity associated with MI 56. For example, an accelerometer can sense movement of MI 56; a capacitive, resistive, electromagnetic, or acoustic touch sensor can sense a user contact with a portion of the MI; a strain gauge, switch, or opto-interrupter can detect the movement of keys 116 on MI 56; a microphone can detect acoustic vibrations in the air or in a surface of MI 56. In one embodiment, a motion detector or opto-interrupter is placed under keys 116 to detect the motion indicating playing action. Upon detection of playing of the musical composition, detection block 120 sends a start recording signal through controller 114, wireless transceiver 112, antenna 113, WAP 28, and communication network 20 to servers 40 using the WPS, Wi-Fi Direct, or another wired or wireless setup protocol. Servers 40 begin storing the audio signals, video signals, control signals, and other data on mass storage arrays. The audio signal is transmitted over a secure connection through controller 114, wireless transceiver 112, antenna 113, WAP 28, and communication network 20 and recorded on cloud servers 40 with associated timestamps, tags, and identifiers. The audio signals, video signals, control signals, and other data can be formatted as MIDI data and stored on servers 40.

Servers 40 continue recording until a stop recording signal is received, recording time-out, or the recording is otherwise disabled. The recording can be disabled by a physical act, such as pressing a stop recording button on MI 56 or accessories 58-68, playing a predetermined note or series of notes on MI 56, voice activation with a verbal instruction "stop recording" through a microphone, or dedicated remote controller. The recording of the musical composition can be disabled after a predetermined period of time or upon detection of the absence of motion of keys 116 or detection of no audio signals being generated by MI 56 for a predetermined period of time. For example, if MI 56 is idle for say 15 minutes, either in terms of physical motion or no audio signal, then the recording is discontinued. The absence of user-initiated activity associated with MI 56 or no audio signal indicates that music is no longer being played and the recording is suspended.

Figure 6:
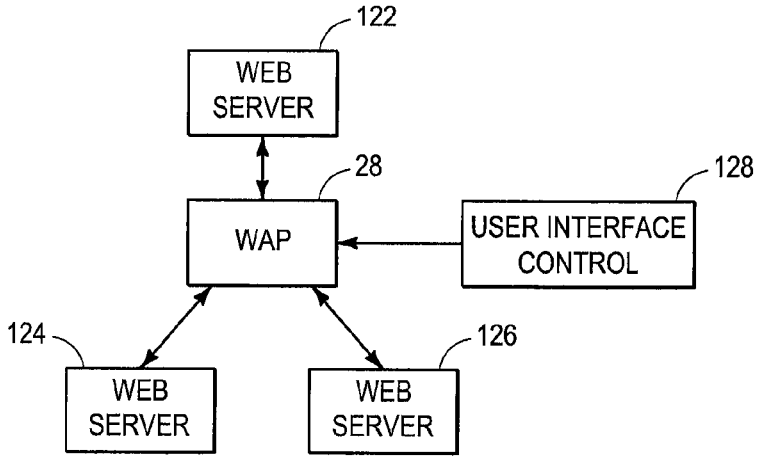
FIG. 6 illustrates a plurality of web servers connected to an access point.

FIG. 6 illustrates a general view of the interconnection between wireless devices 52-68. Web servers 122, 124, and 126 each denote user configured functionality within devices 52-68, i.e., each device 52-68 includes a web server interface, such as a web browser, for configuring and controlling the transmission, reception, and processing of analog or digital audio signals, video signals, control signals, and other data through WAP 28 and over wireless communication network 50 or electronic system 10. The web browser interface provides for user selection and viewing of the control data in human perceivable form. For example, MI 52 includes web server 122 implemented through user configuration of wireless transceiver 70, controller 74, and configuration memory 76; audio amplifier 60 includes web server 124 implemented through user configuration of wireless transceiver 92, controller 96, and configuration memory 98; and MI 56 includes web server 126 implemented through user configuration of wireless transceiver 112, controller 114, and configuration memory 115.

Web servers 122-126 are configured by user control interface 128, see FIGS. 7*a*-7*f*, and communicate with each other through WAP 28 over wireless communication network 50 or electronic system 10. User control interface 128 can be implemented using a web browser with PAN master device 34, laptop computer 58, or mobile communication device 59 to provide a human interface to web servers 122-126, e.g. using a keypad, keyboard, mouse, trackball, joystick, touchpad, touchscreen, and voice recognition system connected to a serial port, USB, MIDI, bluetooth, zigBee, Wi-Fi, or infrared connection of the user control interface.

Web servers 122-126 are configured through user control interface 128 so that each device can share data between MI 52-56, related accessories 58-68, PAN master device 34, and servers 40 through communication network 20. The shared data includes presets, files, media, notation, playlists, device firmware upgrades, and device configuration data. Musical performances conducted with MI 52-56 and related accessories 58-68 can be stored on PAN master device 34, laptop computer 58, mobile communication device 59, and servers 40. Streaming audio and streaming video can be downloaded from PAN master device 34, laptop computer 58, mobile communication device 59, and servers 40 through communication network 20 and executed on MI 52-56 and related accessories 58-68. The streaming audio and streaming video is useful for live and pre-recorded performances, lessons, virtual performance, and social jam sessions, which can be presented on display monitor 66. Camera 68 can record the playing sessions as video signals.

Figure 7A:
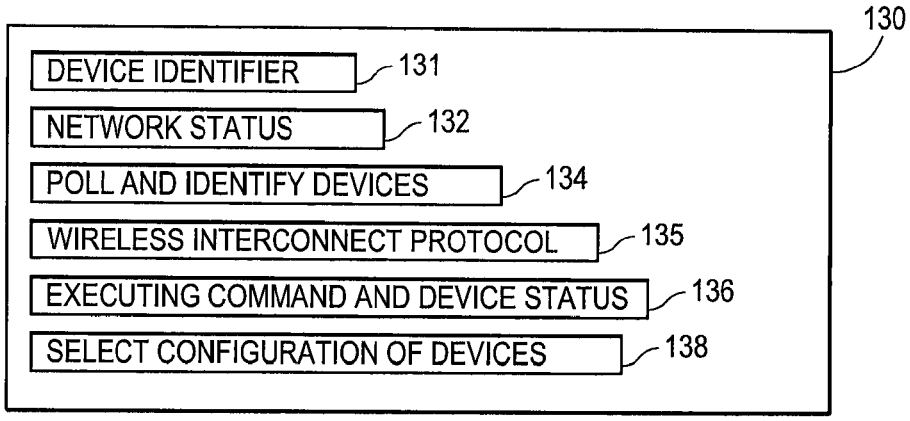
FIGS. 7*a*-7*f* illustrate webpages for monitoring and configuring a musical instrument or musical related accessory.

FIG. 7*a* illustrates web browser based interface for user control interface 128 as displayed on PAN master device 34, laptop computer 58, or mobile communication device 59. Home webpage 130 illustrates the user selectable configuration data for communication network 50. The webpages can be written in HTML, JavaScript, CSS, PHP, Java, or Flash and linked together with hyperlinks, JavaScript, or PHP commands to provide a graphical user interface (GUI) containing JPEG, GIF, PNG, BMP or other images. Home webpage 130 can be local to PAN master device 34, laptop computer 58, or mobile communication device 59 or downloaded from servers 40 and formatted or adapted to the displaying device. Home webpage 130 can be standardized with common features for devices 52-68. For example, the identifier or designation of each device 52-68 in block 131 and network status in block 132 can use a standard format. User control interface 128 can poll and identify devices 52-68 presently connected to WAP 28 in block 134. The wireless interconnect protocol is displayed in block 135. The presently executing commands and status of other devices within wireless communication network 50 are displayed in block 136. The user can select configuration of individual devices 52-68 in wireless communication network 50 in block 138.

Figure 7B:
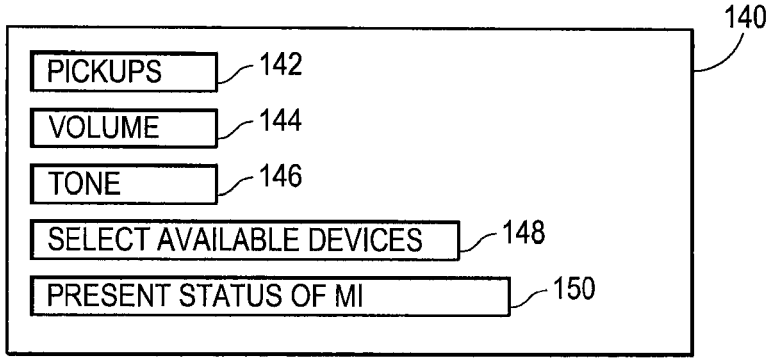

FIG. 7*b* illustrates a configuration webpage 140 within the web browser for MI 52 selected by block 138. Webpage 140 allows configuration of pickups in block 142, volume control in block 144, tone control in block 146, and drop down menu 148 to select from available devices as the destination for the audio signal from MI 52. Webpage 140 also displays the present status of MI 52 in block 150, e.g. musical composition being played and present configuration of MI 52. Additional webpages within the web browser can present more detailed information and selection options for each configurable parameter of MI 52. For example, webpage 140 can recommend string change intervals for MI 52 after a certain number of hours are reached with an option to replace the strings through automated subscription service. The user may elect to automatically receive new strings after each 40 hours of playing time. Webpage 140 can remotely troubleshoot a problem with MI 52 using established test procedures. Webpage 140 can present information in GUI format that mimics the appearance of the knobs and switches available on the exterior of MI 52, communicating the value of each parameter controlled by a knob or switch with a visual representation similar to the actual appearance of the corresponding knob or switch and allowing the parameter to be altered through virtual manipulation of the visual representation on the webpage. Webpage 140 allows the creation, storage, and loading of a plurality of custom configurations for MI 52.

Figure 7C:
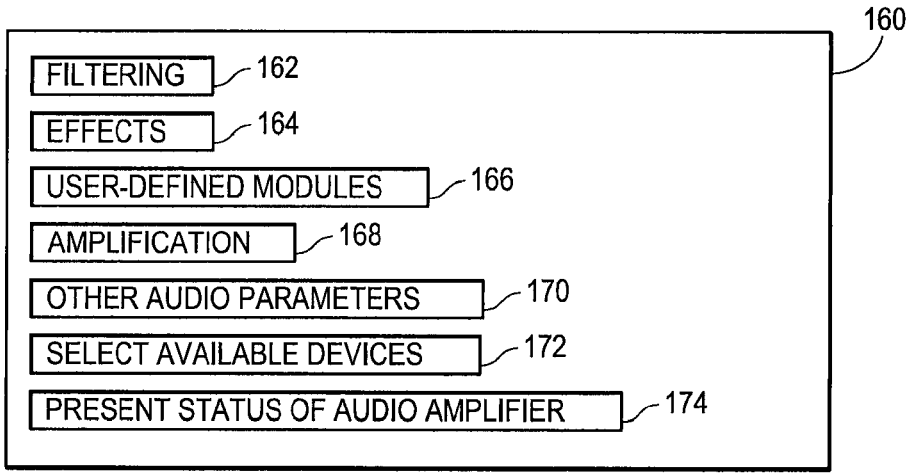

FIG. 7*c* illustrates a configuration webpage 160 within the web browser for audio amplifier 60 selected by block 138. Webpage 160 allows the user to monitor and configure filtering in block 162, effects in block 164, user-defined modules in block 166, amplification control in block 168, other audio parameter in block 170, and select from available devices as the destination for the post signal processing audio signal from audio amplifier 60 in drop down menu 172. Webpage 160 also displays the present status of audio amplifier 60 in block 174, e.g. musical composition being played and present configuration of filter 100, effects 102, user-defined modules 104, and amplification block 106. Additional webpages within the web browser can present more detailed information and selection options for each configurable parameter of audio amplifier 60. For example, the additional webpages can monitor and maintain the working condition of audio amplifier 60, track hours of operation of tubes within the amplifier, recommend tube change intervals, monitoring and allowing adjustment of the bias voltage of tubes within the amplifier, and monitoring temperatures within the amplifier. Webpage 160 can present information in GUI format that mimics the appearance of the knobs and switches available on the exterior of audio amplifier 60, communicating the value of each parameter controlled by a knob or switch with a visual representation similar to the actual appearance of the corresponding knob or switch and allowing the parameter to be altered through virtual manipulation of the visual representation on the webpage. Webpage 160 allows the creation, storage, and loading of a plurality of custom configurations for audio amplifier 60.

Figure 7D:
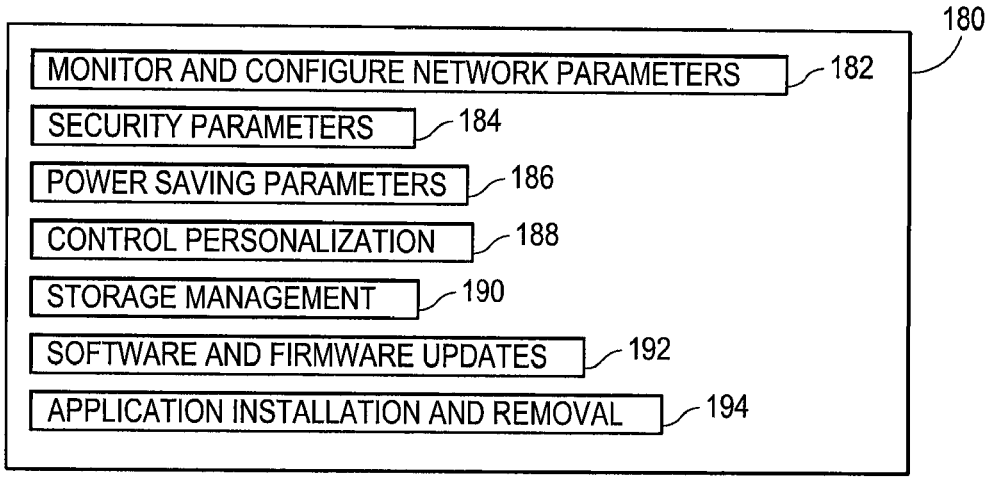

FIG. 7*d* illustrates a configuration webpage 180 for WAP 28 selected by block 138. Webpage 180 allows the user to monitor and configure network parameters in block 182, security parameters in block 184, power saving parameters in block 186, control personalization in block 188, storage management in block 190, software and firmware updates in block 192, and application installation and removal in block 194.

Figure 7E:
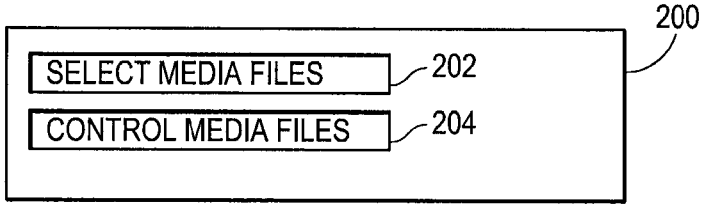

FIG. 7*e* illustrates a configuration webpage 200 for media services selected by block 138. Webpage 200 allows the user to monitor and select one or more media files stored within PAN master device 34, laptop computer 58, mobile communication device 59, or server 40 in block 202. Media files include WAV, MP3, WMA, and MIDI files including media files suitable for use as accompaniment for a performance, such as a drum track, background track, bassline, or intermission program. Webpage 200 includes controls to adjust the volume, pitch, and tempo of the media files in block 204. Webpage 200 can configure a media file to begin play at a set time after audio amplifier 60 is taken off standby, upon receiving a command from an external device, or when WAP 28 detects an audio signal from a musical instrument or microphone connected to audio amplifier 60. Webpage 200 can select the media files for mixing with other audio signals received by audio amplifier 60 and can play the resulting mix through the amplifier.

Figure 7F:
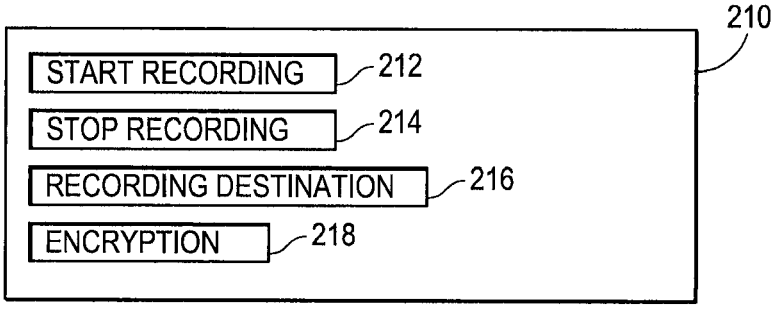

FIG. 7*f* illustrates a configuration webpage 210 for recording audio signals. Webpage 210 allows the user to select a parameter to start recording in block 212. The start recording parameter can be detection of motion of MI, motion of string, touch or handling, presence of audio signal, audible sound, specific note or melody, time of day, location of MI, and continuous recording. Webpage 210 includes a parameter to stop recording in block 214, such as no user activity or audio signal for a predetermined period of time. Block 216 selects the recording destination, i.e., network address and file name of cloud servers 40. The designation of cloud servers 40 is determined by the IP address or URL of the storage servers from the cloud service provider. Alternatively, the address or URL of the storage server or servers is set by the user. Block 218 selects the encryption of the audio signal, video signals, control signals, and other data.

Figure 8:
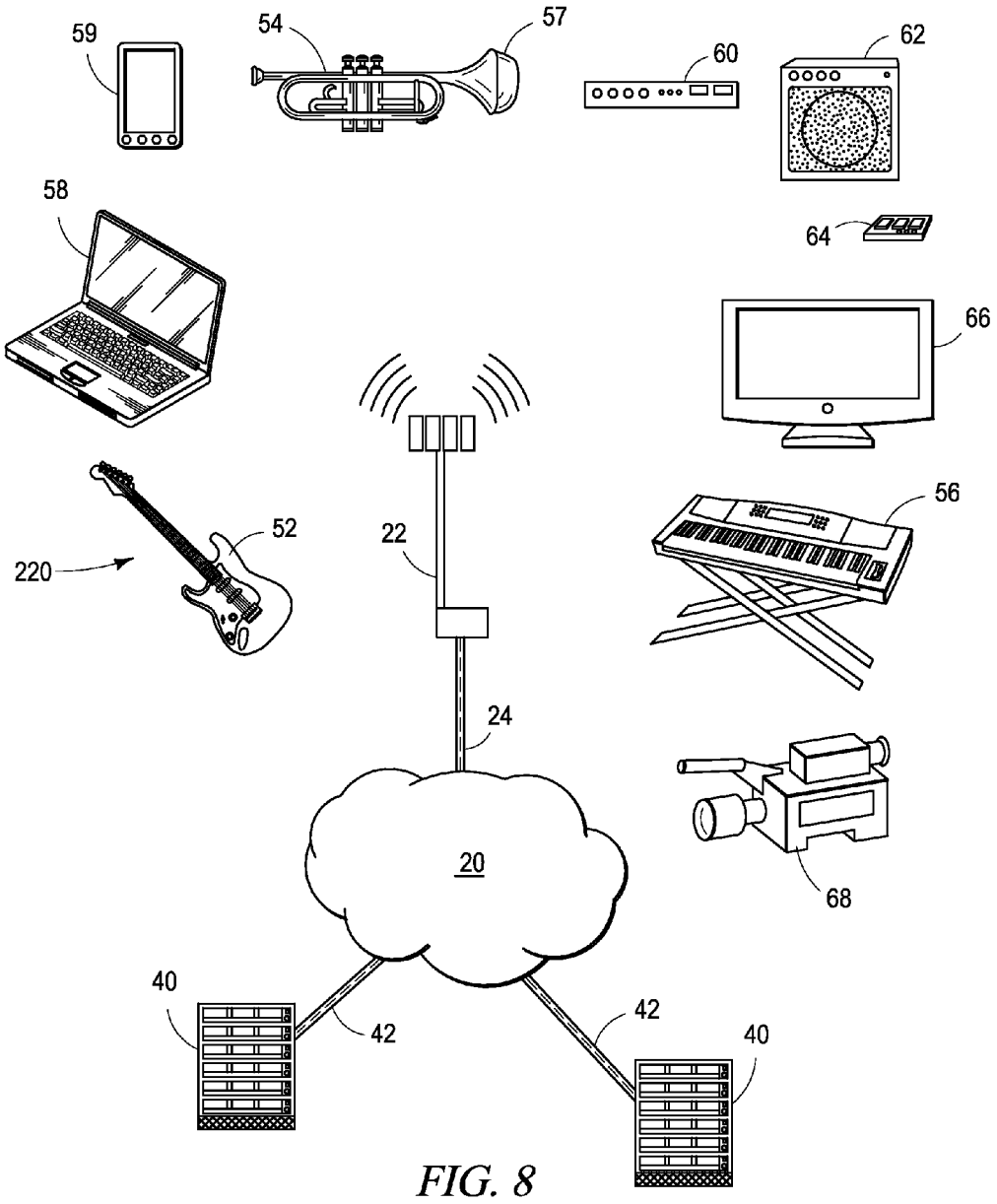
FIG. 8 illustrates musical instruments and musical related accessories connected to a cellular base station.

FIG. 8 shows wireless communication network 220 for connecting, configuring, monitoring, and controlling musical instruments and musical related accessories within the system. In particular, wireless communication network 220 uses cellular base station 22 or cellular mobile Wi-Fi hotspot to send and receive analog or digital audio signals, video signals, control signals, and other data between musical instruments and musical related accessories, as well as other devices within electronic system 10, such as communication network 20 and servers 40. A cellular mobile Wi-Fi hotspot includes smartphones, tablet computers, laptop computers, desktop computers, stand-alone hotspots, MiFi, and similar devices connected to communication network 20 through cellular base station 22. Cellular base station 22 is connected to communication network 20 by communication link 24. Communication network 20 is connected to servers 40 by communication links 42. Cellular base station 22 can also be connected to other devices within electronic system 10, including cellular device 26, Wi-Fi device 32, PAN master device 34, and PAN slave device 38.

In the present embodiment, cellular base station 22 communicates with MI 52-56, as well as other musical instruments such as a violin, brass, drums, wind instrument, string instrument, piano, organ, percussions, keyboard, synthesizer, and microphone. Some musical instruments require a microphone or other sound transducer, such as cone 57 mounted to trumpet 54, to convert sound waves to electrical signals. Cellular base station 22 further communicates with laptop computer 58, mobile communication device 59, audio amplifier 60, speaker 62, effects pedal 64, display monitor 66, and camera 68. MI 52-56 and accessories 58-68 each include an internal or external wireless transceiver and controller to send and receive analog or digital audio signals, video signals, control signals, and other data through cellular base station 22 between and among the devices, as well as communication network 20, cellular device 26, Wi-Fi device 32, PAN master device 34, PAN slave device 38, and servers 40. In particular, MI 52-56 and accessories 58-68 are capable of transmitting and receiving audio signals, video signals, control signals, and other data through cellular base station 22 and communication network 20 to cloud storage implemented on servers 40.

Consider an example where one or more users play a musical composition on MI 52-56. The user may be on stage, in a recording studio, in a home, in a coffee shop, in the park, in a motor vehicle, or any other location with wired or wireless access to cellular base station 22. The user wants to manually or automatically configure MI 52-56 and musical related accessories 60-68 and then record the play of the musical composition. The configuration data of MI 52-56 corresponding to the musical composition is stored on laptop computer 58, mobile communication device 59, or internal memory of the MI. The configuration data for the musical composition is transmitted from laptop computer 58 or mobile communication device 59 through cellular base station 22 to MI 52-56. For MI 52, the configuration data selects one or more pickups on the guitar as the source of the audio signal, as well as the volume and tonal qualities of the audio signal transmitted to an output jack. For MI 54, the configuration data selects sensitivity, frequency conversion settings, volume, and tone of cone 57. For MI 56, the configuration data sets the volume, balance, sequencing, tempo, mixer, tone, effects, MIDI interface, and synthesizer. The configuration data of audio amplifier 60, speaker 62, effects pedal 64, and camera 68 is also stored on laptop computer 58, mobile communication device 59, or internal memory of the accessory. The configuration data for the musical composition is transmitted from laptop computer 58 or mobile communication device 59 through cellular base station 22 to audio amplifier 60, speaker 62, effects pedal 64, and camera 68, as well as other electronic accessories within communication network 220. For audio amplifier 60, the configuration data sets the amplification, volume, gain, filtering, tone equalization, sound effects, bass, treble, midrange, reverb dwell, reverb mix, vibrato speed, and vibrato intensity. For speaker 62, the configuration data sets the volume and special effects. For effects pedal 64, the configuration data sets the one or more sound effects.

Once MI 52-56 and accessories 60-68 are configured, the user begins to play the musical composition. The audio signals generated from MI 52-56 are transmitted through cellular base station 22 to audio amplifier 60, which performs the signal processing of the audio signal according to the configuration data. The audio signal can also be speech or voice data from a microphone. The configuration of MI 52-56 and audio amplifier 60 can be updated at any time during the play of the musical composition. The configuration data is transmitted to devices 52-68 to change the signal processing of the audio signal in realtime. The user can modify the signal processing function during play by pressing on effects pedal 64 to introduce a sound effect. The user operation on effects pedal 64 is transmitted through cellular base station 22 to audio amplifier 60, which implements on the user operated sound effects. Other electronic accessories, e.g. a synthesizer, can also be introduced into the signal processing audio amplifier 60 through cellular base station 22. The output signal of audio amplifier 60 is transmitted through cellular base station 22 to speaker 62. In some cases, speaker 62 handles the power necessary to reproduce the sound. In other cases, audio amplifier 60 can be connected to speaker 62 by audio cable to deliver the necessary power to reproduce the sound.

In addition, the analog or digital audio signals, video signals, control signals, and other data from MI 52-56 and musical related accessories 60-68 are transmitted through cellular base station 22 and stored on laptop computer 58, mobile communication device 59, PAN master device 34, or servers 40 as a recording of the play of the musical composition. The recording can be made at any time and any place with wired or wireless access to electronic system 10 or communication network 220, without prior preparation, e.g. for an impromptu playing session. The destination of the audio signals is selected with PAN master device 34, laptop computer 58, or mobile communication device 59. For example, the user selects the destination of the recording as cloud servers 40. As the user plays the musical composition, the audio signals, video signals, control signals, and other data from MI 52-56 and accessories 60-68 are transmitted through cellular base station 22 in realtime and stored on servers 40. The audio signals, video signals, control signals, and other data can be formatted as MIDI data and stored on servers 40. The recording stored on cloud servers 40 is available for later access by the user or other person authorized to access the recording.

The user may enable the recording of the musical composition by a physical act, such as pressing a start recording button on MI 52-56 or accessories 58-68, playing a predetermined note or series of notes on MI 52-56, voice activation with a verbal instruction "start recording" through a microphone, or dedicated remote controller. The recording of the musical composition can be enabled upon detection of motion, handling, or other user-initiated activity associated with MI 52-56, or detection of audio signals being generated by MI 52-56. The user-initiated activity can be handling an electric guitar, strumming the strings of a bass, pressing keys on the keyboard, moving the slide of a trumpet, and striking a drum. The presence of user-initiated activity or detection of the audio signal indicates that music is being played and initiates the recording. Alternatively, the recording of the musical composition can be enabled during a certain time of day (8 am to 8 pm) or by location detection, i.e., start recording when the user enters the recording studio as detected by GPS within MI 52-56. The recording can be enabled continuously (24×7), whether or not audio signals are being generated. The user can retrieve the recording from servers 40 and listen to the musical composition through speakers 62, PAN slave device 38, laptop computer 58, or mobile communication device 59. The recording as stored on servers 40 memorializes the musical composition for future access and use.

Figure 9:
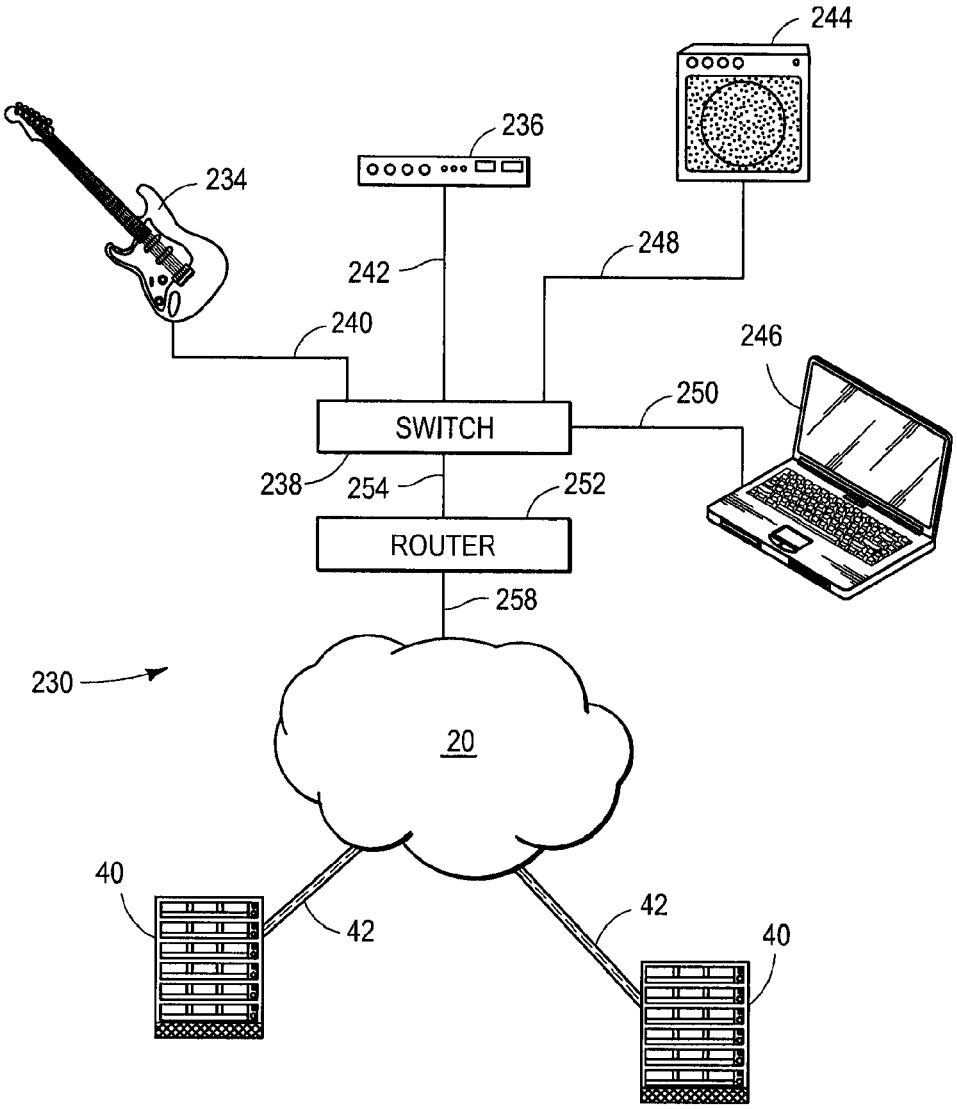
FIG. 9 illustrates musical instruments and musical related accessories connected through a wired communication network.

FIG. 9 shows wired communication network 230 for connecting, configuring, monitoring, and controlling musical instruments and musical related accessories within the system. In particular, communication network 230 uses an IEEE 802.3 standard, i.e., ethernet protocol, with requisite network interface cards, cabling, switches, bridges, and routers for communication between devices. In particular, MI 234 and audio amplifier 236 are connected to switch 238 with cabling 240 and 242, respectively. Speaker 244 and laptop computer 246 are also connected to switch 238 through cabling 248 and 250. Switch 238 is connected to router 252 by cabling 254, which in turn is connected to communication network 20 by communication link 258. Communication network 20 is connected to cloud servers 40 by communication links 42.

In the present embodiment, MI 234 depicted as an electric guitar communicates with audio amplifier 236 through cabling 240 and 242 and switch 238. Audio amplifier 236 communicates with speaker 244 and laptop computer 246 through cabling 248 and 250 and switch 238. MI 234, audio amplifier 236, and speaker 244 can be configured through switch 238 with data from laptop computer 246. The configuration data for the musical composition is transmitted from laptop computer 246 through switch 238 to MI 234. The configuration data selects one or more pickups on the guitar as the source of the audio signal, as well as the volume and tonal qualities of the audio signal transmitted to an output jack. The configuration data of audio amplifier 236 and speaker 244 is also stored on laptop computer 58 or internal memory of the accessory. The configuration data for the musical composition is transmitted from laptop computer 246 through switch 238 to audio amplifier 236 and speaker 244, as well as other electronic accessories within communication network 230. For audio amplifier 236, the configuration data sets the amplification, volume, gain, filtering, tone equalization, sound effects, bass, treble, midrange, reverb dwell, reverb mix, vibrato speed, and vibrato intensity. For speaker 244, the configuration data sets the volume and special effects.

Once MI 234 and accessories 236 and 244 are configured, the user begins to play the musical composition. The audio signals generated from MI 234 are transmitted through switch 238 to audio amplifier 236, which performs the signal processing of the audio signal according to the configuration data. The audio signal can also be voice data from a microphone. The configuration of MI 234 and audio amplifier 236 can be updated at any time during the play of the musical composition. The configuration data is transmitted to devices 234, 236, and 244 to change the signal processing of the audio signal in realtime. The output signal of audio amplifier 236 is transmitted through switch 238 to speaker 244. In some cases, speaker 244 handles the power necessary to reproduce the sound. In other cases, audio amplifier 236 can be connected to speaker 244 by audio cable to deliver the necessary power to reproduce the sound.

In addition, the analog or digital audio signals, video signals, control signals, and other data from MI 234 and musical related accessories 236 and 244 are transmitted through switch 238 and stored on laptop 246 or servers 40 as a recording of the play of the musical composition. The recording can be made at any time and any place with wired or wireless access to electronic system 10 or communication network 230, without prior preparation, e.g. for an impromptu playing session. The destination of the audio signals is selected with laptop computer 246. For example, the user selects the destination of the recording as cloud servers 40. As the user plays the musical composition, the audio signals, video signals, control signals, and other data from MI 234 and accessories 236 and 244 are transmitted through switch 238 in realtime and stored on servers 40. The audio signals, video signals, control signals, and other data can be formatted as MIDI data and stored on servers 40. The recording stored on cloud server 40 is available for later access by the user or other person authorized to access the recording.

The user may enable the recording of the musical composition by a physical act, such as pressing a start recording button on MI 234 or accessories 236 and 244, playing a predetermined note or series of notes on MI 234, voice activation with a verbal instruction "start recording" through a microphone, or dedicated remote controller. The recording of the musical composition can be enabled upon detection of motion, handling, or other user-initiated activity associated with MI 234, or detection of audio signals being generated by MI 234. The presence of user-initiated activity or detection of the audio signal indicates that music is being played and initiates the recording. The recording can be enabled continuously (24×7), whether or not audio signals are being generated. The user can retrieve the recording from servers 40 and listen to the musical composition through speakers 244. The recording as stored on servers 40 memorializes the musical composition for future access and use.

Figure 10:
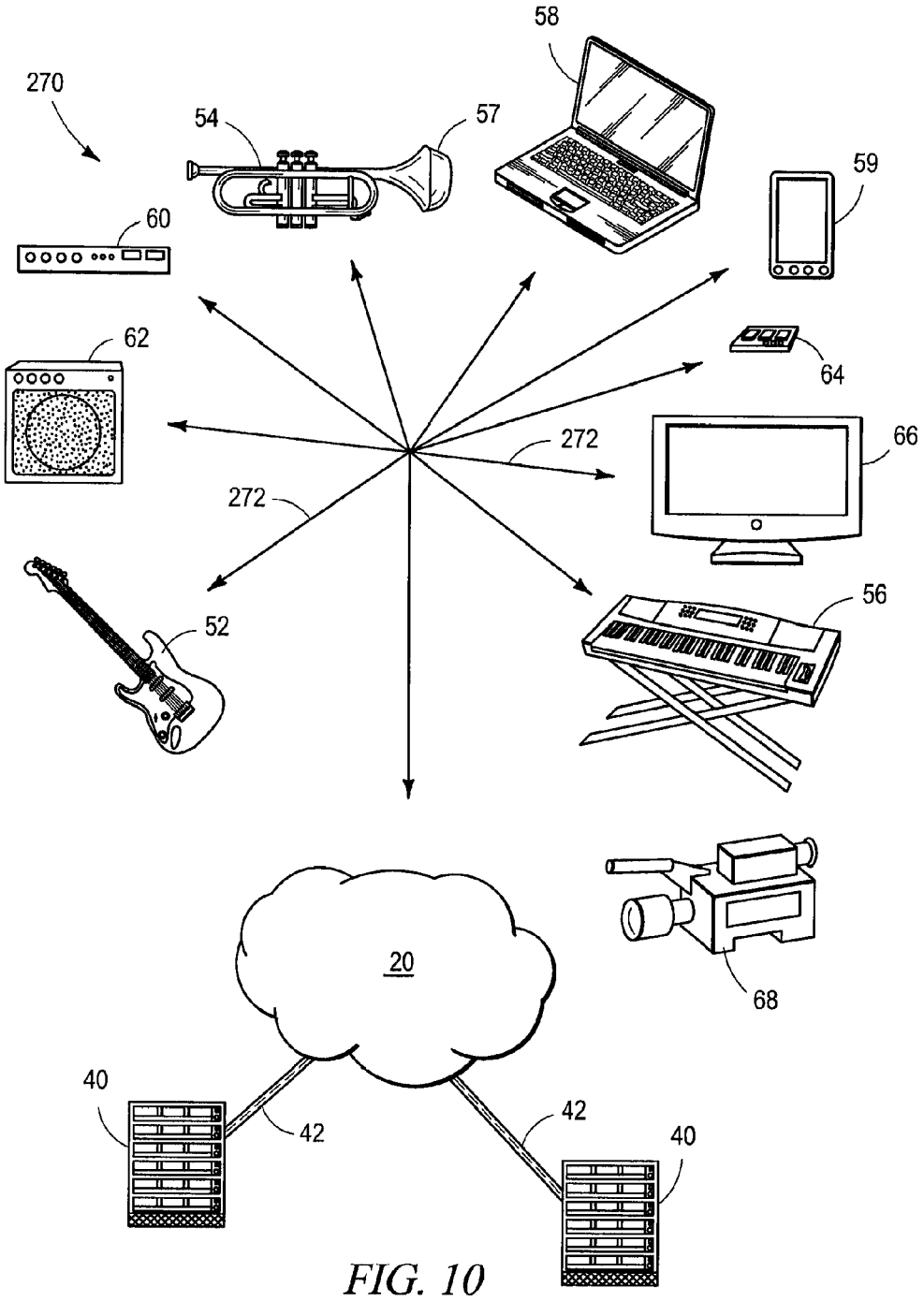
FIG. 10 illustrates musical instruments and musical related accessories connected through an adhoc network.

FIG. 10 illustrates an adhoc communication network 270 for connecting, configuring, monitoring, and controlling musical instruments and accessories within the musical system. In particular, communication network 270 uses wired and wireless direct communication links 272 to send and receive analog or digital audio signals, video signals, control signals, and other data between musical instruments and accessories, as well as other devices within electronic system 10, such as communication network 20 and server 40. Communication link 272 from each device 52-68 polls and connects to other devices within the network or within range of the wireless signal. For example, MI 52 polls, identifies, and connects to audio amplifier 60 through communication links 272; MI 54 polls, identifies, and connects to effects pedal 64 through communication links 272; audio amplifier 60 polls, identifies, and connects to speaker 62 through communication links 272; mobile communication device 59 polls, identifies, and connects to MI 56 through communication links 272; laptop computer 58 polls, identifies, and connects to server 40 through communication links 272.

Consider an example where one or more users play a musical composition on MI 52-56. The configuration data of MI 52-56 is stored on laptop computer 58, mobile communication device 59, or internal memory of the MI. The configuration data for the musical composition is transmitted from laptop computer 58 or mobile communication device 59 through communication links 272 to MI 52-56. For MI 52, the configuration data selects one or more pickups on the guitar as the source of the audio signal, as well as the volume and tonal qualities of the audio signal transmitted to an output jack. For MI 54, the configuration data selects sensitivity, frequency conversion settings, volume, and tone of cone 57. For MI 56, the configuration data sets the volume, balance, sequencing, tempo, mixer, tone, effects, MIDI interface, and synthesizer. The configuration data of audio amplifier 60, speaker 62, effects pedal 64, and camera 68 is also stored on laptop computer 58, mobile communication device 59, or internal memory of the accessory. The configuration data for the musical composition is transmitted from laptop computer 58 or mobile communication device 59 through communication links 272 to audio amplifier 60, speaker 62, effects pedal 64, and camera 68, as well as other electronic accessories within communication network 270. For audio amplifier 60, the configuration data sets the amplification, volume, gain, filtering, tone equalization, sound effects, bass, treble, midrange, reverb dwell, reverb mix, vibrato speed, and vibrato intensity. For speaker 62, the configuration data sets the volume and special effects. For effects pedal 64, the configuration data sets the one or more sound effects.

Once MI 52-56 and accessories 60-68 are configured, the user begins to play the musical composition. The audio signals generated from MI 52-56 are transmitted through communication links 272 to audio amplifier 60, which performs the signal processing according to the configuration data. The audio signal can also be voice data from a microphone. The configuration of MI 52-56 and audio amplifier 60 can be updated at any time during the play of the musical composition according the configuration data set by user control interface 128. The configuration data is transmitted to devices 52-68 to change the signal processing of the audio signal in realtime. The user can modify the signal processing function during play by pressing on effects pedal 64 to introduce a sound effect. The user operation on effects pedal 64 is transmitted through communication links 272 to audio amplifier 60, which implements on the user operated sound effects. Other electronic accessories, e.g. a synthesizer, can also be introduced into the signal processing audio amplifier 60 through communication links 272. The output signal of audio amplifier 60 is transmitted through communication links 272 to speaker 62.

In addition, the analog or digital audio signals, video signals, control signals, and other data from MI 52-56 and musical related accessories 60-68 are transmitted through communication links 272 and stored on laptop computer 58, mobile communication device 59, PAN master device 34, or servers 40 as a recording of the play of the musical composition. The recording can be made at any time and any place with wired or wireless access to electronic system 10 or communication network 270, without prior preparation, e.g. for an impromptu playing session. The destination of the audio signals is selected with PAN master device 34, laptop computer 58, or mobile communication device 59. For example, the user selects the destination of the recording as cloud servers 40. As the user plays the musical composition, the audio signals, video signals, control signals, and other data from MI 52-56 and accessories 60-68 are transmitted through communication links 272 in realtime and stored on servers 40. The audio signals, video signals, control signals, and other data can be formatted as MIDI data and stored on servers 40. The recording stored on cloud servers 40 is available for later access by the user or other person authorized to access the recording.

The user may enable the recording of the musical composition by a physical act, such as pressing a start recording button on MI 52-56 or accessories 58-68, playing a predetermined note or series of notes on MI 52-56, voice activation with a verbal instruction "start recording" through a microphone, or dedicated remote controller. The recording of the musical composition can be enabled upon detection of motion, handling, or other user-initiated activity associated with MI 52-56, or detection of audio signals being generated by MI 52-56. The user-initiated activity can be handling an electric guitar, strumming the strings of a bass, pressing keys on the keyboard, moving the slide of a trumpet, and striking a drum. The presence of user-initiated activity or detection of the audio signal indicates that music is being played and initiates the recording. Alternatively, the recording of the musical composition can be enabled during a certain time of day (8 am to 8 pm) or by location detection, i.e., start recording when the user enters the recording studio as detected by GPS within MI 52-56. The recording can be enabled continuously (24×7), whether or not audio signals are being generated. The user can retrieve the recording from servers 40 and listen to the musical composition through speakers 62, PAN slave device 38, laptop computer 58, or mobile communication device 59. The recording as stored on servers 40 memorializes the musical composition for future access and use.

Figure 11:
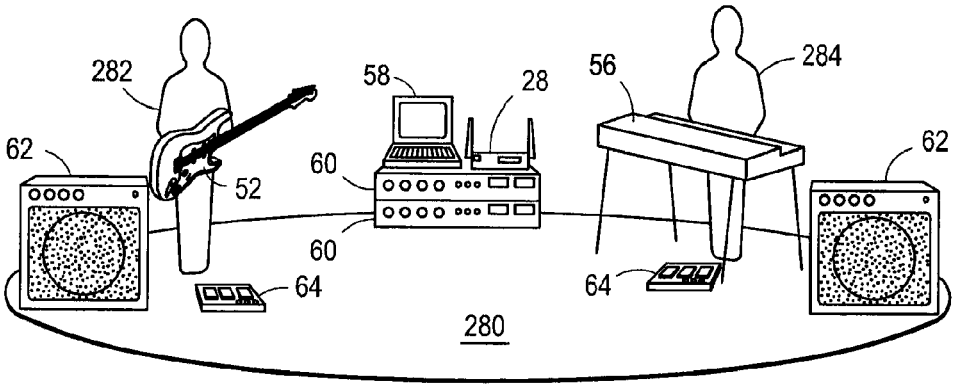
FIG. 11 illustrates a stage for arranging musical instruments and musical related accessories connected through a wireless access point.

Consider an example of setting up and performing one or more musical compositions in a wireless configuration on stage 280 in FIG. 11. Continuing with the wireless network configuration of FIG. 2, MI 52-56 are made available on stage 280 to users 282 and 284. Audio amplifiers 60 and speakers 62 are positioned on stage 280. Effects pedals 64 are placed near the feet of users 282-284. WAP 28 and laptop computer 58 are placed in the vicinity of stage 280. Note that there is no physical cabling to connect MI 52-56, audio amplifiers 60, speakers 62, effects pedals 64, and camera 68. Devices 52-68 are detected through WAP 28 and wirelessly connected and synced through web servers 122-126 using zeroconf, universal plug and play (UPnP) protocols, Wi-Fi direct, or NFC communications. Users 282-284 select, for a given musical composition, configuration data for each of devices 52-68 using webpages 130, 140, 160, 180, and 200 on laptop computer 58. The configuration data is transmitted wirelessly from laptop computer 58 through WAP 28 to the web server interface of devices 52-68. The control features of MI 52-56, e.g. select pickup, volume, tone, balance, sequencing, tempo, mixer, effects, and MIDI interface, are set in accordance with the musical composition. The control features of audio amplifiers 60, speakers 62, effects pedals 64, and camera 68 are set in accordance with the musical composition.

Users 282-284 begin to play MI 52-56. The audio signals generated by MI 52-56 are transmitted through WAP 28 to audio amplifiers 60, speakers 62, effects pedals 64, and camera 68 to wirelessly interconnect, control, modify, and reproduce the audible sounds. The musical composition is played without the use of physical cabling between devices 52-68. The configuration data can be continuously updated in devices 52-68 during the performance according to the emphasis or nature of the musical composition. For example, at the appropriate time, the active pickup on MI 54 can be changed, volume can be adjusted, different effects can be activated, and the synthesizer can be engaged. The configuration of devices 52-68 can be changed for the next musical composition. User 282-284 can stop the performance, e.g. during a practice session, and modify the configuration data via webpages 130, 140, 160, 180, and 200 on laptop computer 58 to optimize or enhance the presentation of the performance. Musical instruments or related accessories not needed for a particular composition can be disabled or taken off-line through WAP 28. Musical instruments or related accessories no longer needed can be readily removed from stage 280 to reduce clutter and make space. WAP 28 detects the absence of one or more devices 52-68 and user control interface 128 removes the devices from the network configuration. Other musical instrument or related accessory can be added to stage 280 for the next composition. The additional devices are detected and configured automatically through WAP 28. The performance can be recorded and stored on servers 40 or any other mass storage device in the network through communication network 50. At the end of the performance, users 282-284 simply remove devices 52-68 from stage 280, again without disconnecting and storing any physical cabling.

In addition, the analog or digital audio signals, video signals, control signals, and other data from MI 52-56 and musical related accessories 60-68 are transmitted through WAP 28 and stored on laptop computer 58, mobile communication device 59, PAN master device 34, or servers 40 as a recording of the play of the musical composition. The recording can be made at any time and any place with wired or wireless access to electronic system 10 or communication network 50, without prior preparation, e.g. for an impromptu playing session. The destination of the audio signals is selected with PAN master device 34, laptop computer 58, or mobile communication device 59. For example, the user selects the destination of the recording as cloud servers 40. As the user plays the musical composition, the audio signals, video signals, control signals, and other data from MI 52-56 and accessories 60-68 are transmitted through WAP 28 in realtime and stored on servers 40. The recording stored on cloud servers 40 is available for later access by the user or other person authorized to access the recording.

The user may enable the recording of the musical composition by a physical act, such as pressing a start recording button on MI 52-56 or accessories 58-68, playing a predetermined note or series of notes on MI 52-56, voice activation with a verbal instruction "start recording" through a microphone, or dedicated remote controller. The recording of the musical composition can be enabled upon detection of motion, handling, or other user-initiated activity associated with MI 52-56, or detection of audio signals being generated by MI 52-56. The user-initiated activity can be handling an electric guitar, strumming the strings of a bass, pressing keys on the keyboard, moving the slide of a trumpet, and striking a drum. The presence of user-initiated activity or detection of the audio signal indicates that music is being played and initiates the recording. Alternatively, the recording of the musical composition can be enabled during a certain time of day (8 am to 8 pm) or by location detection, i.e., start recording when the user enters the recording studio as detected by GPS within MI 52-56. The recording can be enabled continuously (24×7), whether or not audio signals are being generated. The user can retrieve the recording from servers 40 and listen to the musical composition through speakers 62, PAN slave device 38, laptop computer 58, or mobile communication device 59. The recording as stored on servers 40 memorializes the musical composition for future access and use.

Figure 12:
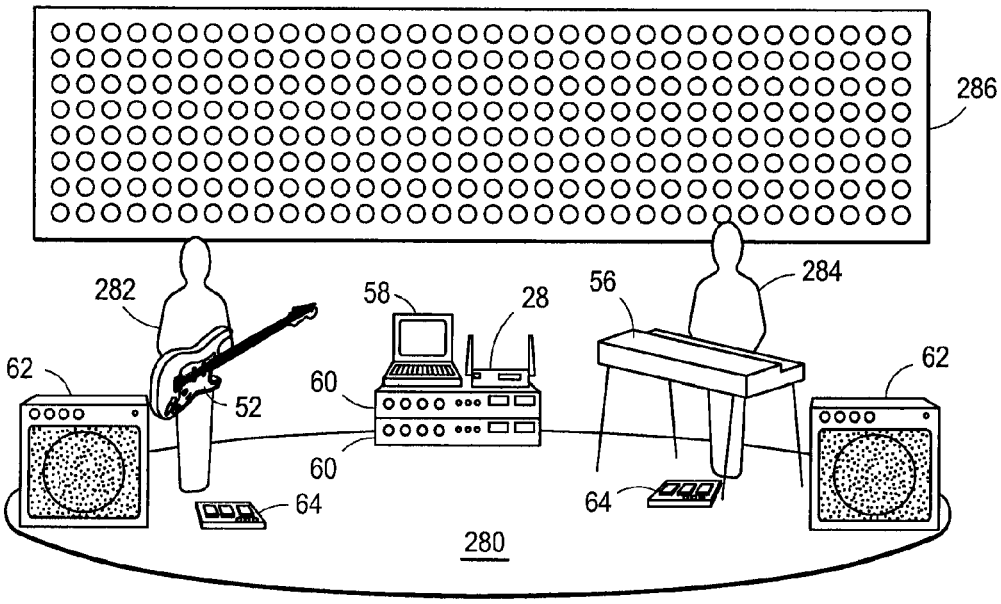
FIG. 12 illustrates a stage with special effects for arranging musical instruments and musical related accessories connected through a wireless access point.

FIG. 12 illustrates WAP 28 further controlling special effects during a musical performance. The configuration data from laptop computer 58 or mobile communication device 59 can be transmitted by WAP 28 to control lighting, lasers, props, pyrotechnics, and other visual and audible special effects 286.

In summary, the communication network connects, configures, monitors, and controls musical instruments and related accessories. The configuration data is transmitted over a wired or wireless connection from laptop computer 58 or mobile communication device 59 through WAP 28 or cellular base station 22 to devices 52-68. The audio signals between MI 52-56 and musical related accessories 60-68 is also transmitted through WAP 28 or cellular base station 22. The user can connect MI 52-56 and accessories 58-68 and record a performance to cloud servers 40 without conscious effort and without needing recording equipment or storage media at the location of the performance. The recording can be created without additional hardware, without interfering with the creative process, without requiring the musician to decide whether to record the performance, and without complex configuration steps. The performance is timestamped to locate the recording of the performance. When the recorded performance includes timestamps for each note, group of notes, or small temporal interval, the timestamps may be used to automatically combine one performance with one or more other simultaneous performances, even if the other simultaneous performances or performances were created at a different location. Alternatively, the musician can locate the recording based on the physical location of the performance or the musical instrument or musical instrument accessory used to create the performance. The recorded performance can be cryptographically signed by a trusted digital notarization service to create an authenticable record of the time, place, and creator of the performance. Subsequently, the musician can download, share, delete, or alter the recorded performance through the file management interface of cloud servers 40 using a smartphone, tablet computer, laptop computer, or desktop computer. The cloud servers 40 offer virtually unlimited storage for recording performances, and the recorded performances are protected against loss.

Accessing a recording on cloud servers 40 may require a password or other credentials or be possible only from authorized devices. Cloud servers 40 provide services for managing the recordings stored on the server, such as renaming, deleting, versioning, journaling, mirroring, backup, and restore. Servers 40 also provide search capabilities that permit a user to find a recording based on the time, geographic location, or device used to make the recording, and may also provide management services, such as cryptographic notarization of the instruments, users, location, and time of a recording.

While one or more embodiments of the present invention have been illustrated in detail, the skilled artisan will appreciate that modifications and adaptations to those embodiments may be made without departing from the scope of the present invention as set forth in the following claims.

What is claimed is:

1. A musical system, comprising:

a musical related instrument including a first communication link disposed on the musical related instrument; and a controller coupled to the first communication link for receiving control data to control operation of the musical related instrument and transmitting a real-time audio signal from the musical related instrument through the first communication link as a cloud storage recording, wherein the real-time audio signal includes an analog audio signal generated by the musical related instrument or a digital sample of an analog audio signal generated by the musical related instrument.

2. The musical system of claim 1, further including a server connected to the first communication link for storing the cloud storage recording.

3. The musical system of claim 1, wherein the cloud storage recording is initiated by detecting motion of the musical related instrument or presence of the real-time audio signal.

4. The musical system of claim 1, further including a music related accessory comprising a second communication link for transmitting and receiving the real-time audio signal and configuration data.

5. The musical system of claim 1, further including a user control interface comprising a plurality of webpages for configuring the musical related instrument.

6. The musical system of claim 1, wherein the musical related instrument is selected from a group consisting of a guitar, violin, horn, brass, drums, wind instrument, string instrument, piano, organ, percussions, keyboard, synthesizer, microphone, audio amplifier, speaker, effects pedal, and camera.

7. The musical system of claim 1, further including a mark indicator to flag recorded data.

8. The musical system of claim 1, wherein the cloud storage recording includes audio data, video data, or configuration data.

9. The musical system of claim 1, wherein the real-time audio signal includes voice data.

10. A method of recording a musical performance, comprising:

providing a musical instrument including a first network interface disposed on the musical instrument;

providing an audio amplifier including a second network interface disposed on the audio amplifier;

providing an access point connected to the musical instrument via the first network interface and the audio amplifier via the second network interface;

transmitting configuration data to the musical instrument and audio amplifier through the access point;

transmitting musical performance data from the musical instrument to the audio amplifier through the access point in real-time; and transmitting the musical performance data from the musical instrument to a computer system identified in the configuration data through the access point in real-time.

11. The method of claim 10, further including providing a server connected to the first network interface for storing the musical performance data as a cloud storage recording.

12. The method of claim 10, further including initiating the musical performance data by detecting motion of the musical instrument.

13. The method of claim 10, further including providing a music related accessory comprising a third network interface for receiving the musical performance data.

14. The method of claim 10, further including a user control interface comprising a plurality of webpages for configuring the musical instrument and audio amplifier.

15. The method of claim 10, wherein the musical instrument is selected from a group consisting of a guitar, violin, horn, brass, drums, wind instrument, string instrument, piano, organ, and percussions.

16. A method of recording a musical performance, comprising:

providing a musical instrument including a first communication link disposed on the musical instrument;

providing an access point connected to the musical instrument via the first communication link;

transmitting configuration data to the musical instrument through the access point; and transmitting real-time musical performance data from the musical instrument to a computer system identified in the configuration data through the access point, wherein the transmitted real-time musical performance data includes a digital data packet with a destination network address read from the configuration data.

17. The method of claim 16, further including providing a server connected to the first communication link for storing the real-time musical performance data as a cloud storage recording.

18. The method of claim 16, further including initiating the real-time musical performance data by detecting motion of the musical instrument.

19. The method of claim 16, further including providing a music related accessory comprising a second communication link for receiving the real-time musical performance data.

20. The method of claim 16, further including a user control interface comprising a plurality of webpages for configuring the musical instrument.

21. The method of claim 16, wherein the musical instrument is selected from a group consisting of a guitar, violin, horn, brass, drums, wind instrument, string instrument, piano, organ, and percussions.

22. The method of claim 16, further including transmitting a location of the musical instrument through the first communication link using a Global Positioning System device disposed on the musical instrument.

23. A method of recording a musical performance, comprising:

providing a musical related instrument including a first communication link disposed on the musical related instrument; and streaming musical performance data from the musical related instrument through the first communication link to a cloud server, wherein the musical performance data includes an analog audio signal generated by the musical instrument or a digital representation of an audio signal generated by the musical instrument.

24. The method of claim 23, further including storing the musical performance data on the cloud server as a cloud storage recording.

25. The method of claim 23, further including initiating the musical performance data by detecting motion of the musical related instrument.

26. The method of claim 23, further including providing a music related accessory comprising a second communication link for receiving the musical performance data.

27. The method of claim 23, further including a user control interface comprising a plurality of webpages for configuring the musical related instrument.

28. The method of claim 23, wherein the musical related instrument is selected from a group consisting of a guitar, violin, horn, brass, drums, wind instrument, string instrument, piano, organ, percussions, microphone, audio amplifier, speaker, effects pedal, and camera.

29. The method of claim 23, further including monitoring a status of the musical related instrument via the first communication link.

30. The method of claim 23, further including transmitting a location of the musical related instrument through the first communication link using a Global Positioning System device disposed on the musical related instrument.

31. The method of claim 16, wherein the access point includes a cellular mobile Wi-Fi hotspot.

* * * * *